US012416464B2

(12) United States Patent
Wohlstein et al.

(10) Patent No.: US 12,416,464 B2
(45) Date of Patent: Sep. 16, 2025

(54) SHOOTING REST STABILIZER SYSTEM

(71) Applicant: Valen Foundry Inc., Dover, DE (US)

(72) Inventors: Scott Wohlstein, West Chester, OH (US); Fred Koeck, Stroudsburg, PA (US); Burn LaForce, Edgewood, NM (US); William Rankin, Jr., Medina, OH (US); Ron Sanden, Liberty Township, OH (US); Alexander Strack, West Chester, NM (US); Larry Wright, St. Paul, MN (US)

(73) Assignee: Valen Foundry Inc., Dover, DE (US)

( * ) Notice: Subject to any disclaimer, the term of this patent is extended or adjusted under 35 U.S.C. 154(b) by 0 days.

(21) Appl. No.: 18/762,184

(22) Filed: Jul. 2, 2024

(65) Prior Publication Data

US 2024/0353196 A1 Oct. 24, 2024

Related U.S. Application Data

(63) Continuation-in-part of application No. 17/103,824, filed on Nov. 24, 2020, now Pat. No. 12,031,799.

(60) Provisional application No. 62/954,873, filed on Dec. 30, 2019.

(51) Int. Cl.
*F41A 23/16* (2006.01)

(52) U.S. Cl.
CPC ..... *F41A 23/16* (2013.01)

(58) Field of Classification Search
CPC ..... F41A 23/16; F41A 23/00; F41A 23/02
See application file for complete search history.

(56) References Cited

U.S. PATENT DOCUMENTS 4,409,826 A * 10/1983 Wenger ..... F41A 23/16 73/167
4,621,563 A * 11/1986 Poiencot ..... F41A 23/16 73/167
5,070,636 A * 12/1991 Mueller ..... F41A 23/16 73/167
5,419,233 A * 5/1995 Mulvaney ..... F41A 23/16 73/167
6,526,687 B1 * 3/2003 Looney ..... F41A 23/16 42/94
7,086,192 B2 * 8/2006 Deros ..... F41B 5/1449 248/278.1
8,307,576 B1 * 11/2012 Bogart ..... F41A 23/16 248/176.1
9,546,839 B1 * 1/2017 Hancosky ..... F41A 23/16
(Continued)

*Primary Examiner* — Joshua E Freeman
(74) *Attorney, Agent, or Firm* — Jenei LLC

(57) ABSTRACT

A shooting rest stabilizer is configured to resist movement of a shooting rest in response to firing of a firearm or weapon supported by the shooting rest. The shooting rest stabilizer includes a base plate having an orifice to receive an adjustment bolt/leg of a shooting rest, a back mounting block engageable to a back support, a front right mounting block engageable to a front right support, and a front left mounting block engageable to a front left support. The supports are securable to a stationary base surface. A front lateral fixture is couplable between the front right and front left supports to receive front legs of the shooting rest. Back, front right, and front left elongate supports are attached between the base plate and respective mounting blocks. The shooting rest stabilizer. A unitary mount support platform includes at least the back, front right, and front left supports.

10 Claims, 36 Drawing Sheets

(56) References Cited

U.S. PATENT DOCUMENTS

| | | | | |
|---|---|---|---|---|
| 9,568,265 | B2 * | 2/2017 | Bastian, Jr. | F41A 23/18 |
| 9,618,292 | B1 * | 4/2017 | Hancosky | F41A 25/00 |
| 9,829,265 | B2 * | 11/2017 | Reed | F41A 23/16 |
| 2006/0230664 | A1 * | 10/2006 | Eddins | F41C 27/22 42/94 |
| 2007/0068379 | A1 * | 3/2007 | Sween | F41A 23/16 73/167 |
| 2008/0209790 | A1 * | 9/2008 | Bartle | F41A 23/16 42/94 |
| 2011/0197748 | A1 * | 8/2011 | Roberts | F41A 23/16 89/43.01 |
| 2016/0054091 | A1 * | 2/2016 | Bricko | F41A 23/16 42/94 |
| 2016/0363408 | A1 * | 12/2016 | Reed | F41A 23/16 |
| 2017/0102203 | A1 * | 4/2017 | Cauley, Jr. | F41A 23/16 |
| 2017/0363382 | A1 * | 12/2017 | Hutson | F41A 19/08 |

* cited by examiner

SHOOTING REST STABILIZER SYSTEM

CROSS REFERENCE TO RELATED APPLICATIONS

The present application is a continuation-in-part of U.S. patent application Ser. No. 17/103,824 filed Nov. 24, 2020, which claimed the priority benefit of U.S. Provisional Patent Application No. 62/954,873, filed Dec. 30, 2019, both of which entitled "System and Method for Increasing Accuracy of Shooter and Firearm," the contents of both of which are incorporated herein by reference in their entirety for all purposes.

BACKGROUND

1. Technical Field

The present disclosure relates in general to shooting rests for holding a firearm during test firings and measurements.

2. Description of the Related Art

Bench or shooting rests are used to stabilize a firearm or weapon for adjusting and sighting the weapon or optimizing ammunition. The "rests" may absorb the forces originating from the weapon and/or simply allow the weapon to rest upon them, providing a stable location from which to shoot. However, certain movements of the rest relative to the underlying support may be undesirable. In an example, the rest may longitudinally displace as "non-resetting recoil displacement. The distal end of the rest may experience a rest jump. The barrel of the weapon may experience barrel lift, drop, or other movement. The barrel of the weapon may experience a twist within the rest.

SUMMARY OF THE INVENTION

In one aspect, the present disclosure provides a shooting rest stabilizer system that has a shooting rest stabilizer including a base plate having an orifice configured to receive a downward projecting rear adjustment bolt or leg of a shooting rest. The shooting rest stabilizer is configured to resist movement of the shooting rest in response to firing of a firearm or weapon supported by the shooting rest. The base plate includes an interface mechanism that is selectively lockable to the adjustment bolt or leg to allow for vertical adjustment of the adjustment bolt or leg. The shooting rest stabilizer includes a back mounting block engageable to a back support. The shooting rest stabilizer includes a front right mounting block engageable to a front right support. The shooting rest stabilizer includes a front left mounting block engageable to a front left support. The back support, the front right support and the front left support are securable to a stationary base surface. The shooting rest stabilizer system includes a front lateral fixture that is couplable between the front right support and the front left support to receive a front right leg and a front left leg of the shooting rest. The shooting rest stabilizer includes a back elongate support attached between a rear edge of the base plate and the back mounting block. The shooting rest stabilizer includes a front right elongate support attached between a front right edge of the base plate and the front right mounting block. The shooting rest stabilizer includes a front left elongate support attached between a left front edge of the base plate and the front left mounting block.

These and other features are explained more fully in the embodiments illustrated below. It should be understood that in general the features of one embodiment also may be used in combination with features of another embodiment and that the embodiments are not intended to limit the scope of the invention.

BRIEF DESCRIPTION OF THE DRAWINGS

The description of the illustrative embodiments can be read in conjunction with the accompanying figures. It will be appreciated that for simplicity and clarity of illustration, elements illustrated in the figures have not necessarily been drawn to scale. For example, the dimensions of some of the elements are exaggerated relative to other elements. Embodiments incorporating teachings of the present disclosure are shown and described with respect to the figures presented herein, in which:

FIGS. 18A-18C are side, top and front views of the assembled shooting rest stabilizer, rifle, shooting rest, and shooting rest mount, according to one or more embodiments;

DETAILED DESCRIPTION

Figure 1:
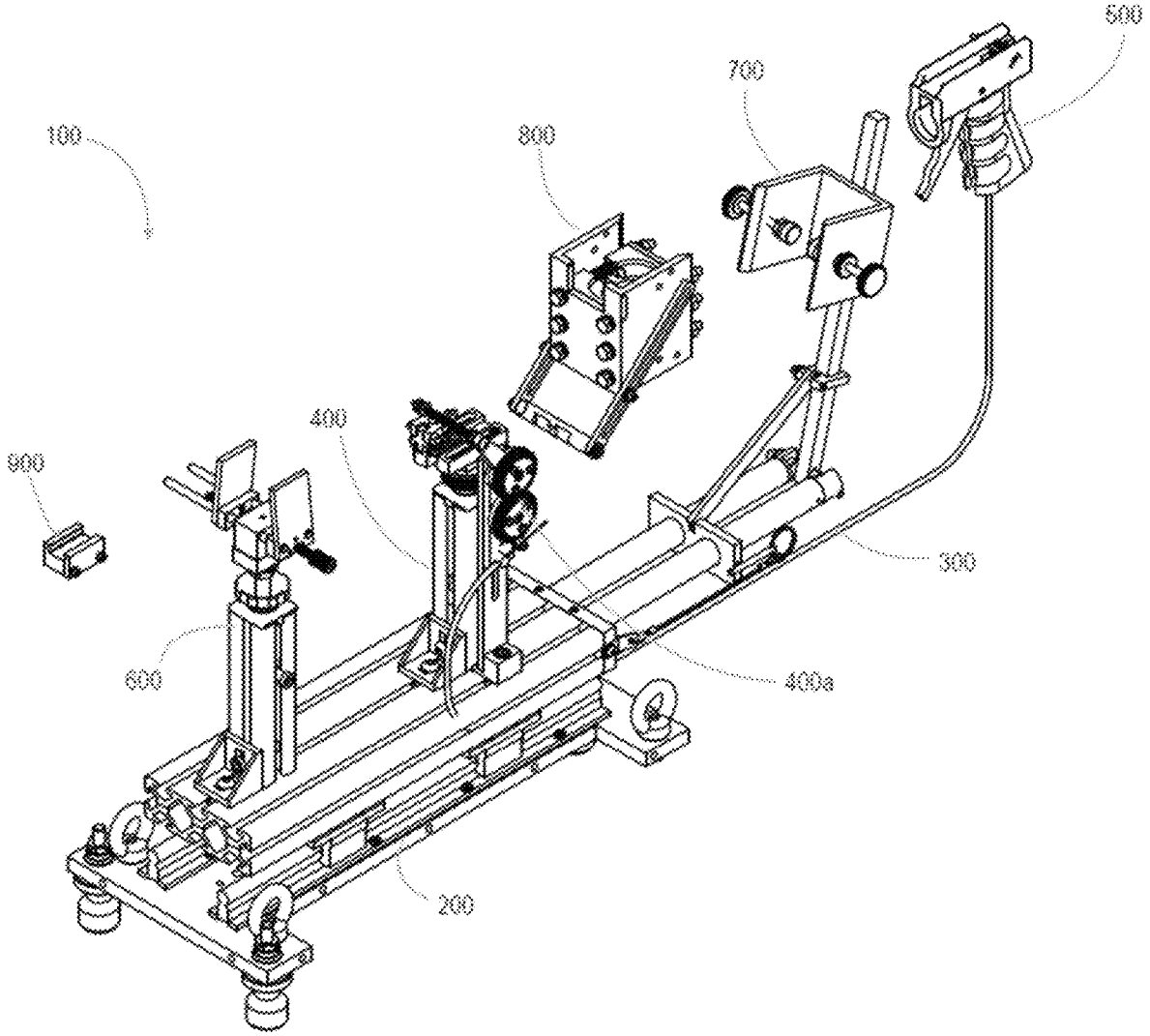
FIG. 1 illustrates a system, according to one or more embodiments.

According to aspects of the present disclosure, a shooting rest stabilizer is attachable to a bench or shooting rest and to stationary or static surface (e.g., ground covering, anchored table, etc.). The shooting rest, or merely "rest", may be according to aspects of the present disclosure provided herein or may be a conventional bench/shooting rest with typical components. When fired, a firearm or weapon creates a variety of static forces and kinetic motion. When the weapon is placed and secured in the shooting rest, the motion from the weapon when firing is taken into account by the shooting rest. In particular, when the weapon is fired, slides, bearings, springs, hydraulic cylinders, and other commonly used devices of the shooting rest ensure that the weapon is held firmly while mitigating the recoil physics exhibited by the weapon and while being retained by the shooting rest.

The shooting rest stabilizer may be sized and configured for use in conjunction with prior art shooting and/or bench rests or for embodiments described herein according to the present disclosure. The shooting rest stabilizer may include the following elements all part of the same assembly or system. An interface selectively unlocks to a shooting rest to enable adjustment to a position in space as needed, then locked into a non-moving position onto a base plate. Base plate provides proximal receptacles or mounting points required by supports. Supports provide competing compression and expansion forces to base plate to dampen oscillations and are distally attached respectively to mounting blocks. Mounting blocks are attachable to a fixed, rigid, static body such as the static body. In one or more embodiments, a support bar suspended between supports toward the front supports for stability. In one or more embodiments, each support is expandable and compressible to compensate for the position in three-dimensional space for the base plate. The supports provide simultaneous compression and expansion of which creates a pre-loaded condition to reduce movement of bench/shooting rest.

According to other aspects of the present disclosure, a system and method for increasing performance of shooter and firearm is provided. The present disclosure provides for a system comprising an operator device configured to receive and transmit one or more data sets over a network and a server and data management module configured to receive and transmit one or more data sets over a network. The server and data management module further comprises a registration customer service submodule and a partner services submodule.

In another embodiment, the present disclosure provides for a system comprising a base assembly, a safety lanyard assembly, a grip/trigger assembly, a remote trigger assembly, a forend assembly, a stock assembly, a grip cradle subassembly, and a Picatinny-style mount. The base assembly further comprises a dog bone assembly, a longitudinal rail assembly, and a plurality of swivel leveling mounts affixed to a plate of the dog bone assembly.

The stock assembly is operably connected to the longitudinal rail assembly and comprises a stock cradle, a brace, a first extension tube and a second extension tube, a plate configured to couple the first and second extension tubes, and a link base configured to connect the brace with the first and second extension tubes.

A grip/trigger assembly is operably connected to the longitudinal rail assembly and further comprises an adjustable upright grip/trigger tower affixed to the longitudinal rail assembly via a corner brace, a trigger guard holding mechanism affixed to the adjustable upright grip/trigger tower, a trigger guard gripper affixed to the trigger guard holding mechanism, a grip cradle subassembly, and a trigger engagement mechanism, part of the remote trigger assembly, affixed to the longitudinal rail assembly, comprises a plurality of gears configured to engage a trigger when activated.

A forend assembly is operably connected to the longitudinal rail assembly and further comprises an adjustable upright forend tower affixed to the longitudinal rail assembly via a corner brace, and a forend clamp mechanism, which is affixed to the adjustable upright forend tower. A Picatinny-style mount maybe alternatively and operably connected to the adjustable upright forend tower instead of the forend clamp mechanism.

A remote trigger assembly comprises a trigger engagement subassembly operably connected to the longitudinal rail assembly and comprises a plurality of gears configured to engage a trigger when activated is operably connected to remote pistol grip assembly comprises a remote pistol grip, a trigger handle, a pin, and a spring, coupled to a holder and a cable where the cable is further affixed to the pin.

A safety lanyard assembly comprises a lanyard, a pin operably connected to the lanyard via a cable, and an anchor end, where the anchor end is operably coupled to the longitudinal rail assembly. The pin is inserted into the remote pistol grip to prevent unintended operation when not ready to fire the firearm.

The system and method disclosed herein are configured for use by consumers (for recreational, competition, and long-range/high accuracy), manufacturers (for research and development R&D/D, test, and QA/QC), and/or for use by first responders, law-enforcement, and the military. The system and method are designed to be compatible with all manufactured firearms and for use by operators with a wide variety of skill level and experience.

In one or more embodiments, the present disclosure provides a rig configured so as to hold a firearm in place, having a rig sensor suite including a plurality of sensors including a base sensor, a top of rail sensor, a stock sensor, a grip trigger sensor, and a forend sensor. In one or more embodiments, the present disclosure provides an operator sensor suite including at least four different pressure, orientation, displacement, acceleration, or position sensors including a chest pad sensor, a head sensor, a grip trigger sensor, and a forend sensor. In one or more embodiments, the present disclosure provides a first extension tube and a second extension tube, a plate configured to couple the first and second extension tubes, and a link base configured to connect the brace with the first and second extension tubes.

References within the specification to "one embodiment," "an embodiment," "embodiments", or "one or more embodiments" are intended to indicate that a particular feature, structure, or characteristic described in connection with the embodiment is included in at least one embodiment of the present disclosure. The appearance of such phrases in various places within the specification are not necessarily all referring to the same embodiment, nor are separate or alternative embodiments mutually exclusive of other embodiments. Further, various features are described which may be exhibited by some embodiments and not by others. Similarly, various requirements are described which may be requirements for some embodiments but not other embodiments.

It is understood that the use of specific component, device and/or parameter names and/or corresponding acronyms thereof, such as those of the executing utility, logic, and/or firmware described herein, are for example only and not meant to imply any limitations on the described embodiments. The embodiments may thus be described with different nomenclature and/or terminology utilized to describe the components, devices, parameters, methods and/or functions herein, without limitation. References to any specific protocol or proprietary name in describing one or more elements, features or concepts of the embodiments are provided solely as examples of one implementation, and such references do not limit the extension of the claimed embodiments to embodiments in which different element, feature, protocol, or concept names are utilized. Thus, each term utilized herein is to be given its broadest interpretation given the context in which that terms is utilized.

Reference will now be made in detail to the embodiments of the present disclosure, examples of which are illustrated in the accompanying drawings. Wherever possible, the same reference numbers will be used throughout the specification to refer to the same or like parts.

The present disclosure provides for a complete ecosystem, comprising software, hardware, and intelligence gathering in the form of data from a rig and/or operator. Each component of the ecosystem provides advantages over the prior art not only as part of the ecosystem as a whole, but also as individual elements. The ecosystem: (1) creates a user community and provides opportunities for receiving relevant content (such as advertising, retailer links, and other valuable content); (2) provides opportunities for engaging with other users (i.e., forum, contests and game); (3) provides opportunities for engaging with instructors and trainers; (4) provides opportunities for advertisers to reach these users with targeted messages or sponsorship; and (5) provides opportunities for manufacturers of firearms, firearm components/accessories/performance features, and ammunition as well as operator accessories and performance features to share data. Any/all these opportunities may be gained locally or at a remote location/distance.

The present disclosure provides for a system and method for measuring and characterizing the performance of a shooter, with and/or without accessories and/or performance features, and one or more associated firearms, with and/or without accessories and/or performance features and making recommendations for improving the performance of each. Software may enable the connection between hardware (the rig) and operator via one or more sensor(s) suites to enable data gathering from the rig and/or operator and feedback (via direct or indirect means) to be provided regarding each and/or both. In one embodiment, the sensor(s) suite may comprise use of a LASER for alignment and LIDAR for displacement measurements among the other sensors within the sensor suite, and combinations thereof.

For example, the software may enable one or more data sets to be collected from the rig and/or the operator and processing this data to determine a target position for the rig and/or the operator. The software may also enable additional data sets to be collected each time the operator uses the rig or firearm or steps into position to shoot. Such software may process the data collected from the various sensor(s) suites and compare the data with the target position saved for the rig and/or operator. This comparison may generate a number of different notifications to the user such as: (1) how far off their current rig and/or operator position is from the target position; and (2) what adjustments should be made correct their stance, firearm alignment, and/or body alignment so that the rig and operator are in the target position. Once an operator has fired the firearm, the software may enable the collection of post-firing data such as accuracy to target, providing immediate feedback on performance to enable the operator to make the necessary adjustments, as well as firearm and accessory information such as performance and predictive/preventative service and maintenance.

The present disclosure provides for an improved rig design that is configured so as to hold a firearm in place at the same points as an operator while returning the firearm to an original resting start position that is practically impossible for a human to accomplish after each cycle of operations of the firearm. Such positioning enables the most realistic and accurate data matching in terms of performance and can be used to generate data related to firearm performance managing predicted maintenance and service and preventing firearm failure. Due to the flexibility and modular nature of the rig design, it can be easily manipulated to hold a wide variety of different types of firearms and provides for uncorrupted operation of the firearm including ammunition and magazine changes. The design allows the firearm to operate as designed with translation and recoil mitigation. In one embodiment, the hardware is also configured with a variable recoil system that matches the platform while considering a "return to battery" and human retention and response. Unlike systems of the prior art, the present rig design does not rely on a mounted optic element as the centroid element.

It is also contemplated that the system of the present disclosure can be used in an indoor or an outdoor environment and can be used with a single user or configured with interconnectivity so that multiple users can interact while using the system, such as for competition or gaming.

The design also enables magazine changes without removing the firearm and does not touch the barrel but allows any/all barrels to float freely. In one embodiment, actual recoil may be measured by determining the mass of the firearm by first measuring the entire mass of the rig with the firearm in-place, then subtracting/taring the constant or known weight of the rig and applying F=MA to the displacement and accelerometric data and physically measuring the actual recoil compared with the data obtained through the sensor(s) suite in the stock cradle assembly used to determine felt (or measurable) recoil.

The combination of software and hardware enables robust intelligence gathering to support a complete ecosystem including firearms platforms (and their manufacturers of firearms, firearm components/accessories/performance features, and ammunition), as well as their operators and other individuals. Such an ecosystem may support targeted marketing campaigns by retailers, virtual competitions between rigs, and/or operators, and valuable operability information to manufacturers regarding the firearms, accessories, and components they manufacture. Examples of data that may be generated include, but are not limited to:

(a) Matching the best ammunition for a particular firearm.
(b) Enabling efficient and effective recalls for firearms and accessories based on firearm platform and operator performance data.
(c) Setting alerts and notifications for predictive maintenance for firearm and accessories.
(d) Setting alerts and notifications for operational reminders.
(e) Allowing data to be collected and assessed across multiple users.
(f) Enabling baselines to be established for firearms and operators.
(g) Measure shooting accuracy, distance between shots, distance to target, and other measurable results to enable users to make improvements and permit competition among various users.
(h) Correlate data of the operator to various demographic data sets.
(i) Setting alerts and notifications for scheduling shooting reminders to maintain consistent practice schedule in order to retain performance improvements.
(j) Provide sanitized demographic and geographic intelligence to advertisers.
(k) Assisting the manufacturers of firearms, firearm components/accessories/performance features, and ammunition, to produce the best product match to market.

Referring now to the drawings, FIG. 1 is illustrative of a system of the present disclosure. The system 100 comprises a plurality of assemblies and subassemblies which are operably connected to enable operation of the system 100. These assembles and subassemblies include a base assembly 200, a safety lanyard assembly 300, a grip/trigger assembly 400, a remote pistol grip assembly 500, a forend assembly 600, a stock cradle assembly 700, a grip cradle subassembly 800, and a Picatinny-style mount 900. Each of the foregoing assemblies and subassemblies are described in more detail below.

Figure 2A:
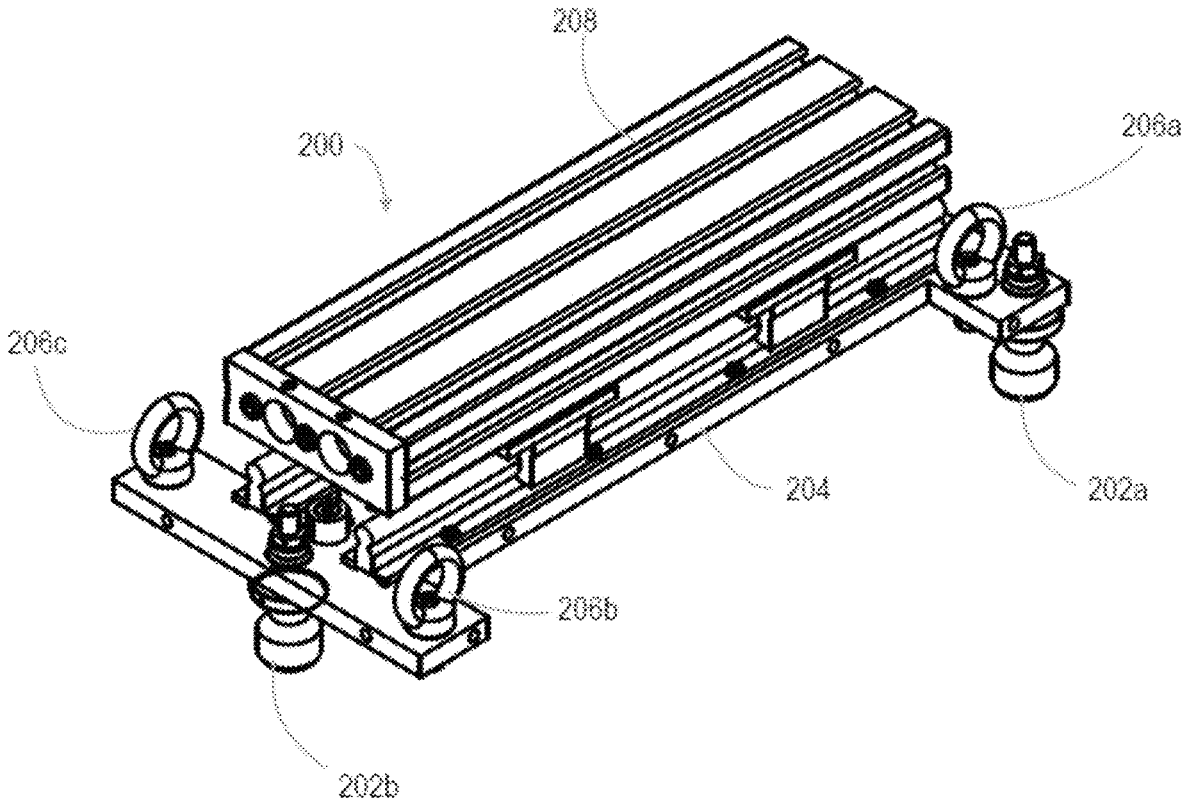
FIG. 2A is illustrative of a base assembly of a system, according to one or more embodiments.
Figure 2B:
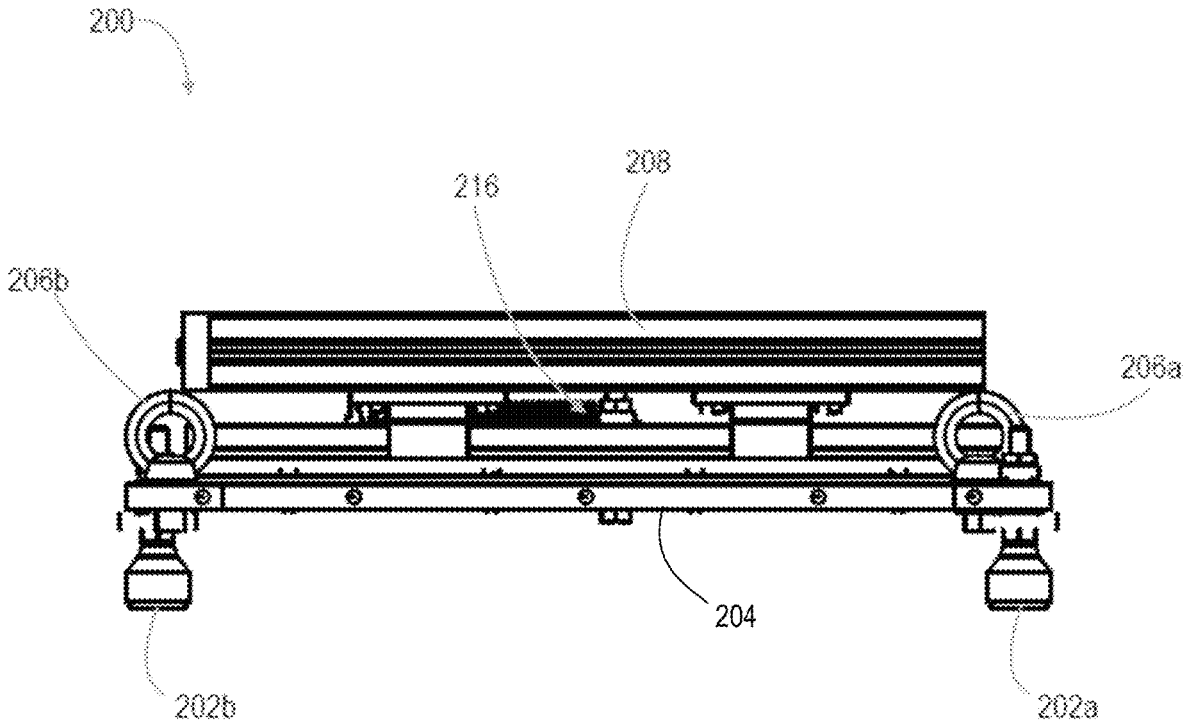
FIG. 2B is illustrative of a base assembly of a system, according to one or more embodiments.
Figure 2C:
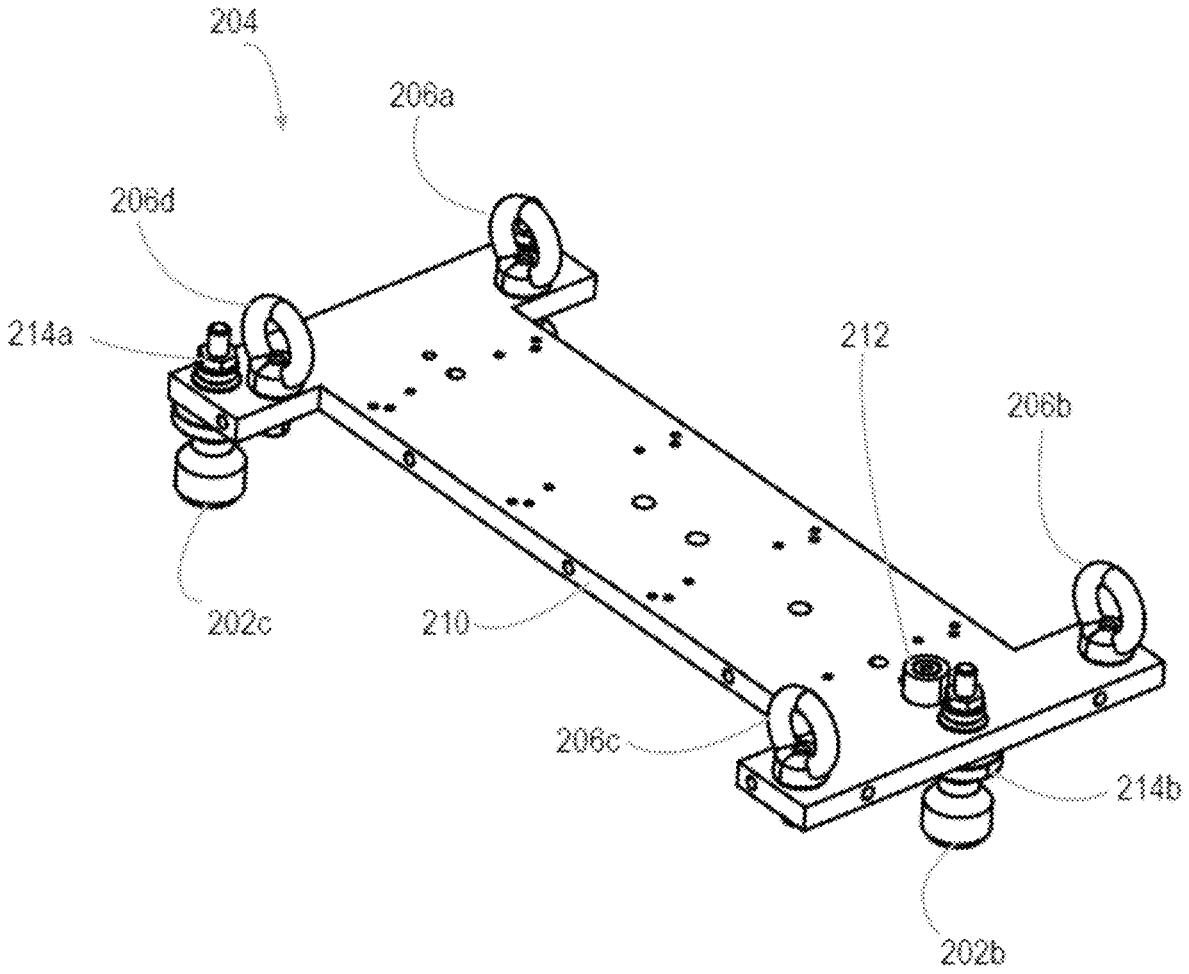
FIG. 2C is illustrative of a dog bone assembly of a system, according to one or more embodiments.

The base assembly 200 is illustrated in detail in FIGS. 2A-2C. As seen in the figures, the base assembly comprises a plurality of swivel leveling mounts 202*a*, 202*b*, and 202*c* which serve as a foundation for the system 100 and also provide for an adjusting mechanism that can be used to adjust the overall height of the system 100 or to adjust the height of one part of the system 100 to account or uneven terrain. The swivel leveling mounts 202*a*, 202*b*, and 202*c* are each affixed to a plate 210 of a dog bone assembly 204. The dog bone assembly is illustrated in FIG. 2C. A plurality of eye nuts 206*a*, 206*b*, 206*c*, and 206*d* are also affixed to the plate 210 of the dog bone assembly 204. The dog bone assembly 204 is operably coupled to a longitudinal rail assembly 208. The plate 210 also comprises a bull's eye level 212 and a plurality of knurled knob assemblies 214*a* and 214*b* which are used to affix each of the swivel leveling mounts to the plate 210. A recoil spring 216 is further affixed to the longitudinal rail assembly 208 and to the dog bone assembly 204 to allow the linear translation of the longitudinal rail assembly 208 and to return it to rest under (adjustable for a wide range of recoil pressure) spring tension.

Figure 3:
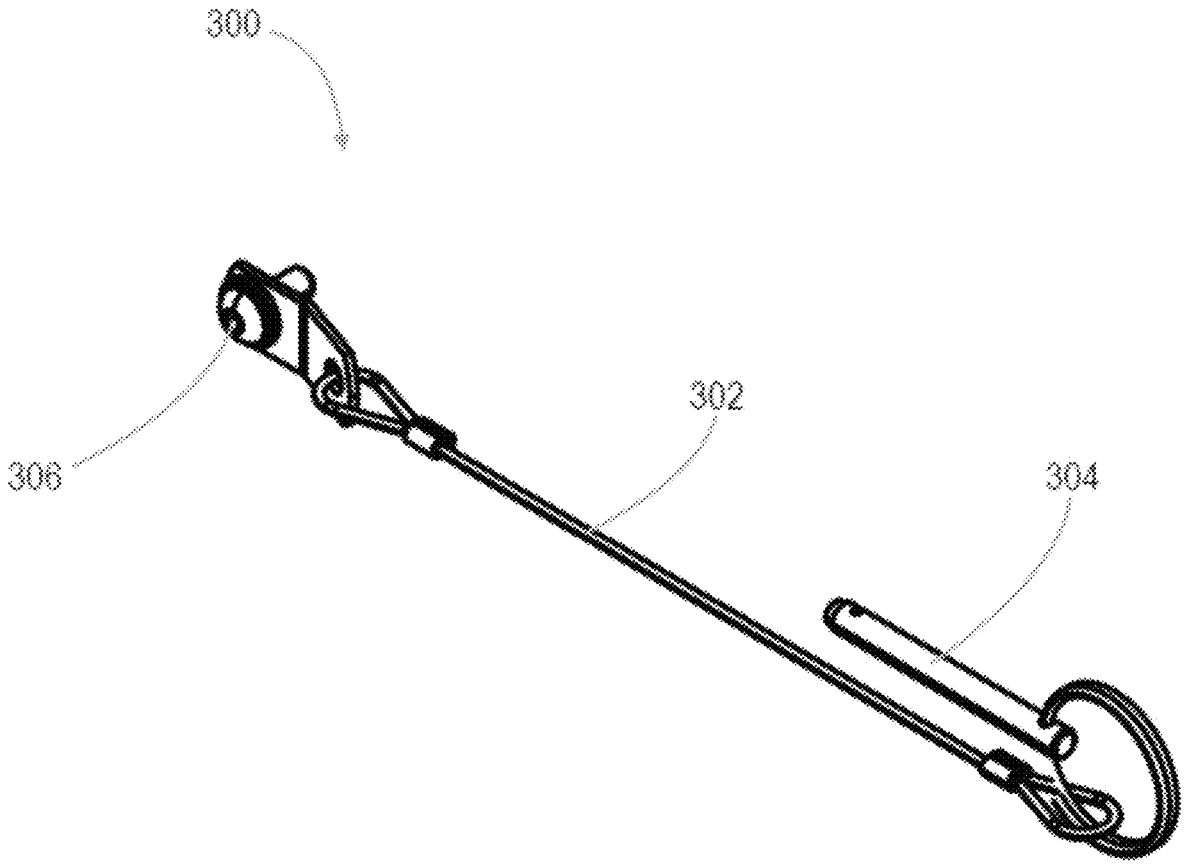
FIG. 3 is illustrative of a safety lanyard assembly of a system, according to one or more embodiments.

The system further comprises a safety lanyard assembly 300 which is illustrated in FIG. 3. The safety lanyard assembly 300 comprises a lanyard 302 with a pin 304 and an anchor end 306, where the anchor end is configured to be operably coupled to the longitudinal rail assembly 208 using plurality of washers and button head cap screw. The pin 304 is operably coupled to the remote pistol grip subassembly 502 to prevent unintended operation.

Figure 4A:
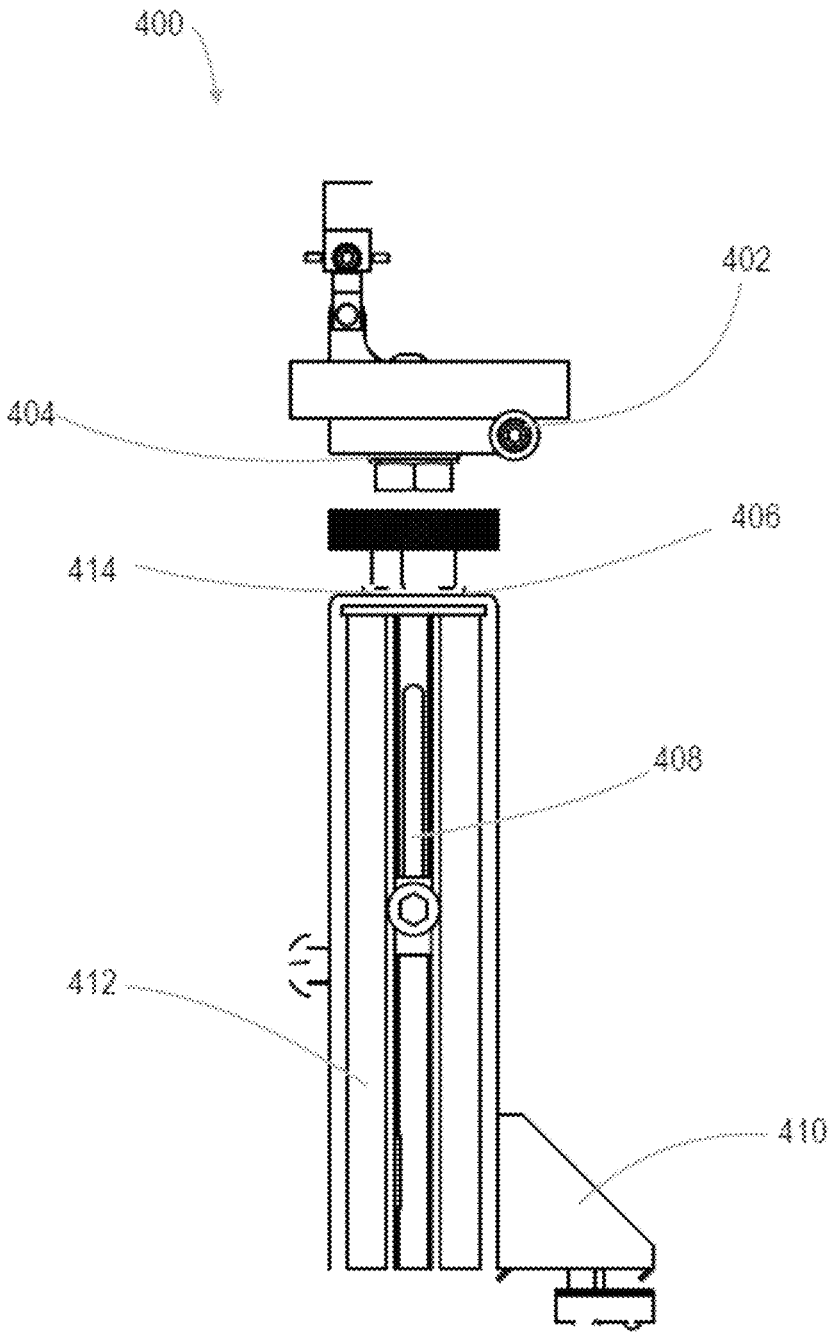
FIG. 4A is illustrative of a grip/trigger assembly of a system, according to one or more embodiments.
Figure 4B:
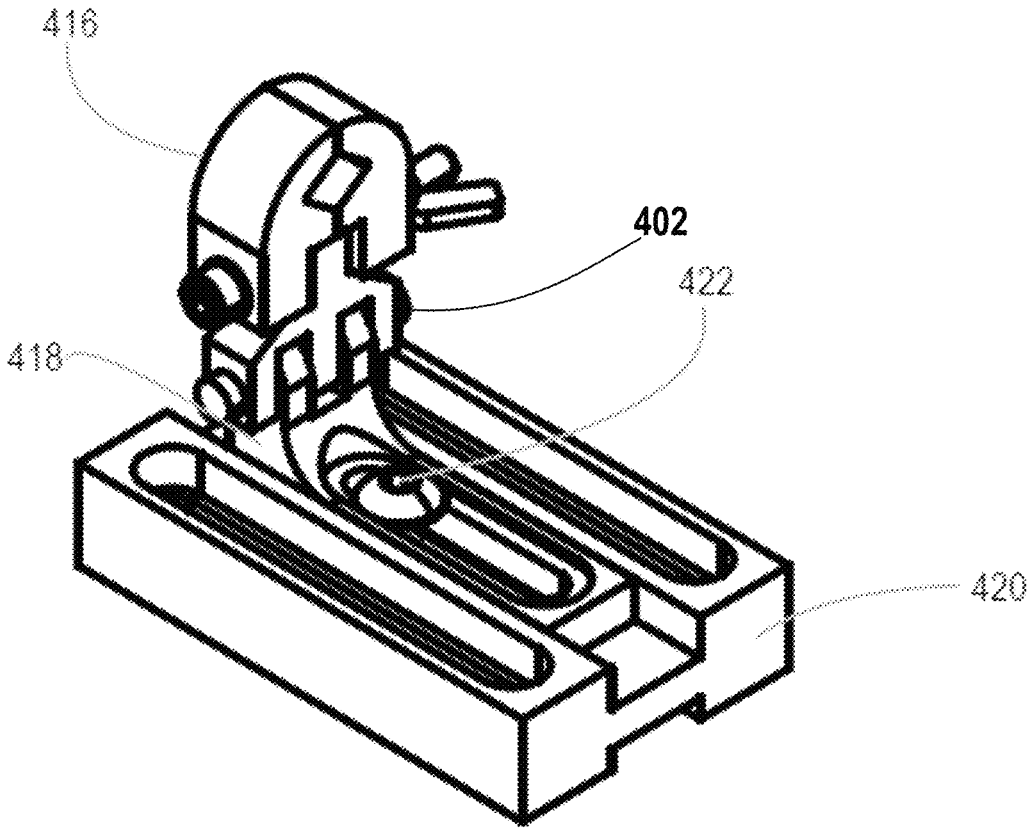
FIG. 4B is illustrative of a trigger guard gripper of a system, according to one or more embodiments.
Figure 4C:
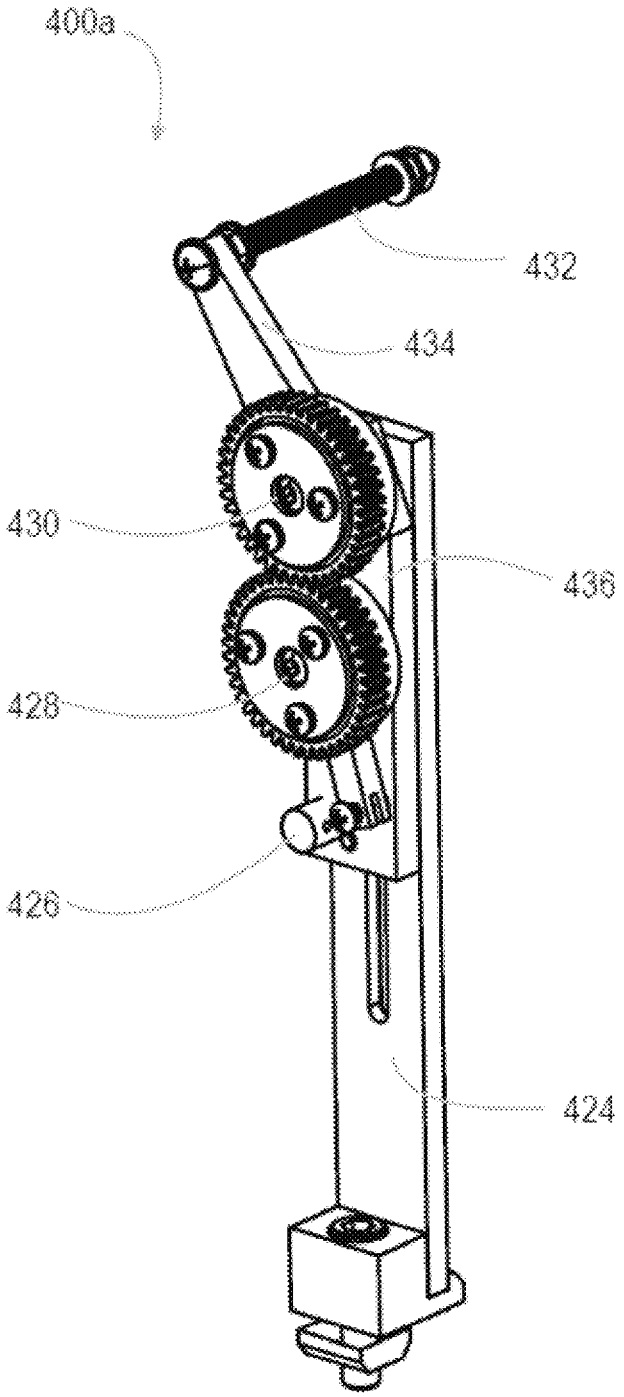
FIG. 4C is illustrative of trigger engagement subassembly of a system, according to one or more embodiments.

The system 100 further comprises a grip/trigger assembly 400 which is operably connected to the longitudinal rail assembly 208 of base assembly 200. The grip/trigger assembly is illustrated by FIGS. 4A-4C and comprises an upright grip/trigger tower 412 is affixed to the longitudinal rail assembly 208 of base assembly 200 via a corner brace 410 and may be adjusted via a plurality of nuts and bolts 408 to achieve the desired height of the grip/trigger assembly 400. The upright grip/trigger tower 412 is affixed to a trigger guard holding mechanism 402 using an adjusting rod 404, end cap 406 and washer 414. The grip/trigger assembly 400 further comprises a trigger guard gripper 416 connected to a block 420 using a brace 418 and a button head cap screw 422.

The trigger pull assembly 400A illustrated by FIG. 4C further comprises a trigger engagement mechanism 434 affixed to a trigger engagement bar (contains a plurality of nuts and washers and bolt contained within a spring 432. A plurality of gears, comprising a top gear 430 and a bottom gear 428 are operably connected and configured so as to enable the trigger engagement mechanism 434 to engage when activated. The plurality of gears 430 and 428 are affixed to a plate 436 which is used as a mount for the plurality of gears 430. A cable holder 426 may be used to affix the plurality of gears 430 and 428 to the plate 436 and the plate 436 may be further affixed to an upright member 424. This upright member 424 may be further affixed to the grip/trigger assembly 400 and to the longitudinal rail assembly 208 of base assembly 200.

Figure 5A:
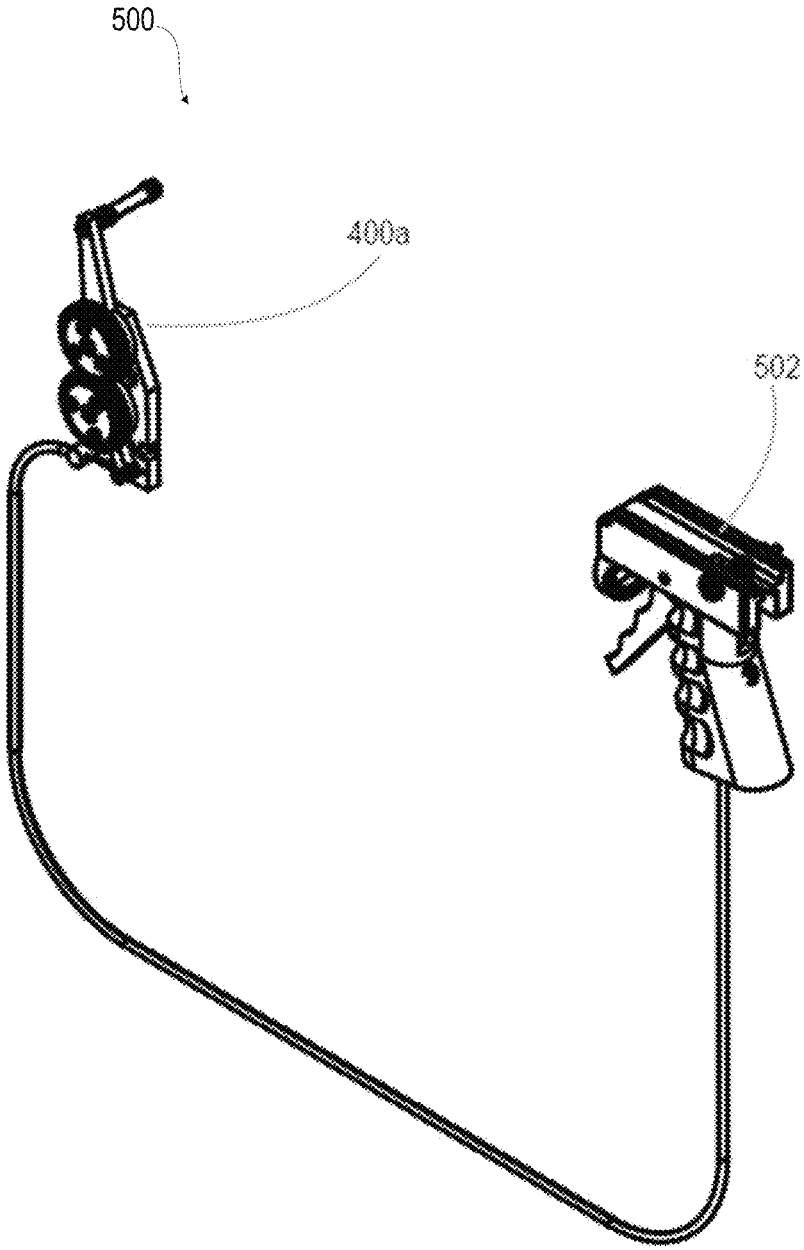
FIG. 5A is illustrative of a remote trigger assembly of a system, according to one or more embodiments.
Figure 5B:
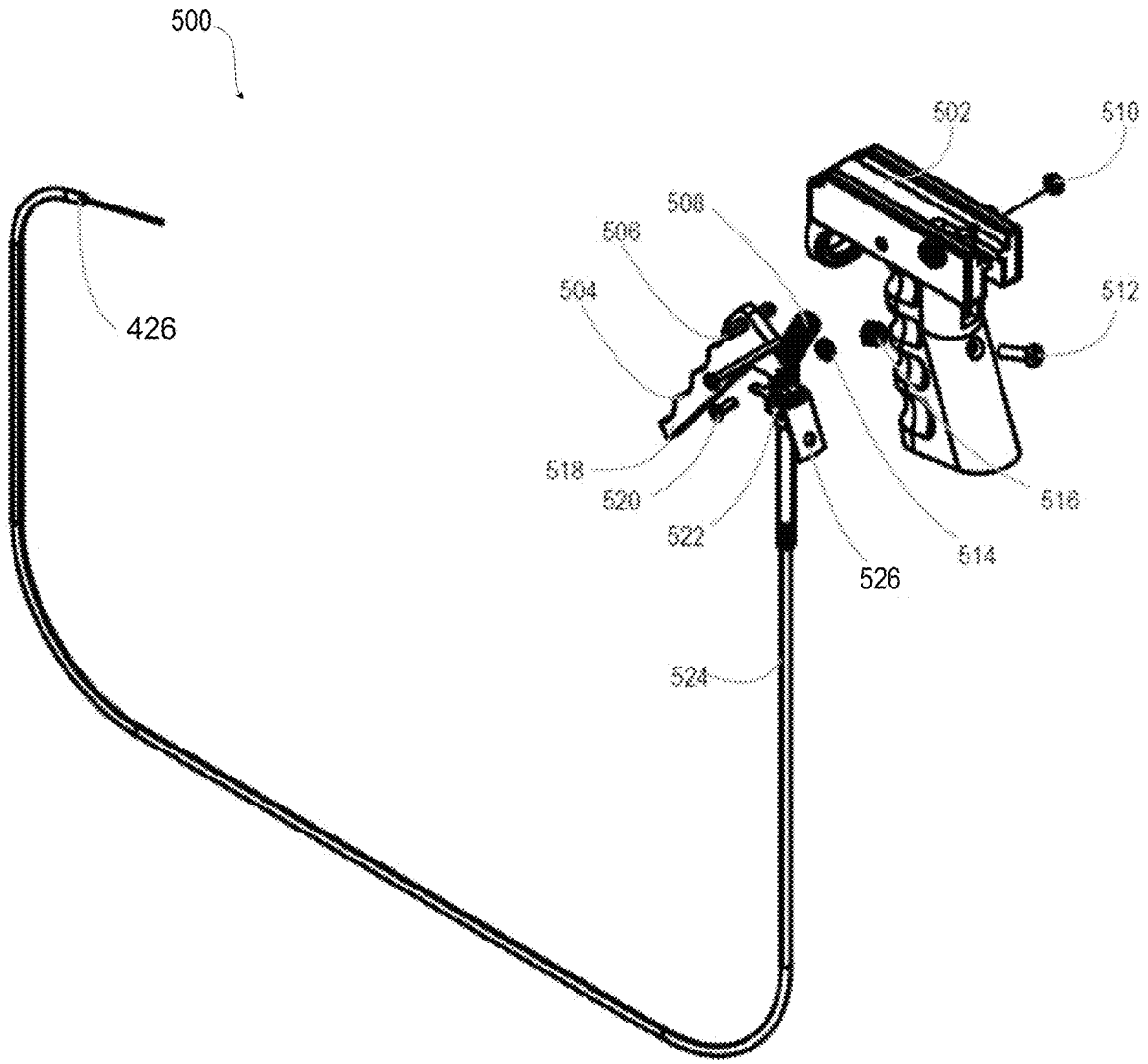
FIG. 5B is illustrative of a remote pistol grip assembly of a system, according to one or more embodiments.

The system 100 further comprises a remote pistol grip assembly 500 which is illustrated in FIGS. 5A-5B. The remote pistol grip assembly 500 is configured to enable remote operation of the system 100 and firing of a firearm. The remote pistol grip assembly comprises a remote pistol grip 502 and a trigger handle 504. A pin 506 allows trigger handle 504 to pivot. A spring 508 is coupled to a holder 526 and cable 524, where the cable 524 is further affixed to gear 428 through holder 426. A plurality of screws 518, 520, 510, 512, and 516 are used to secure the elements of the remote pistol grip assembly.

Figure 6:
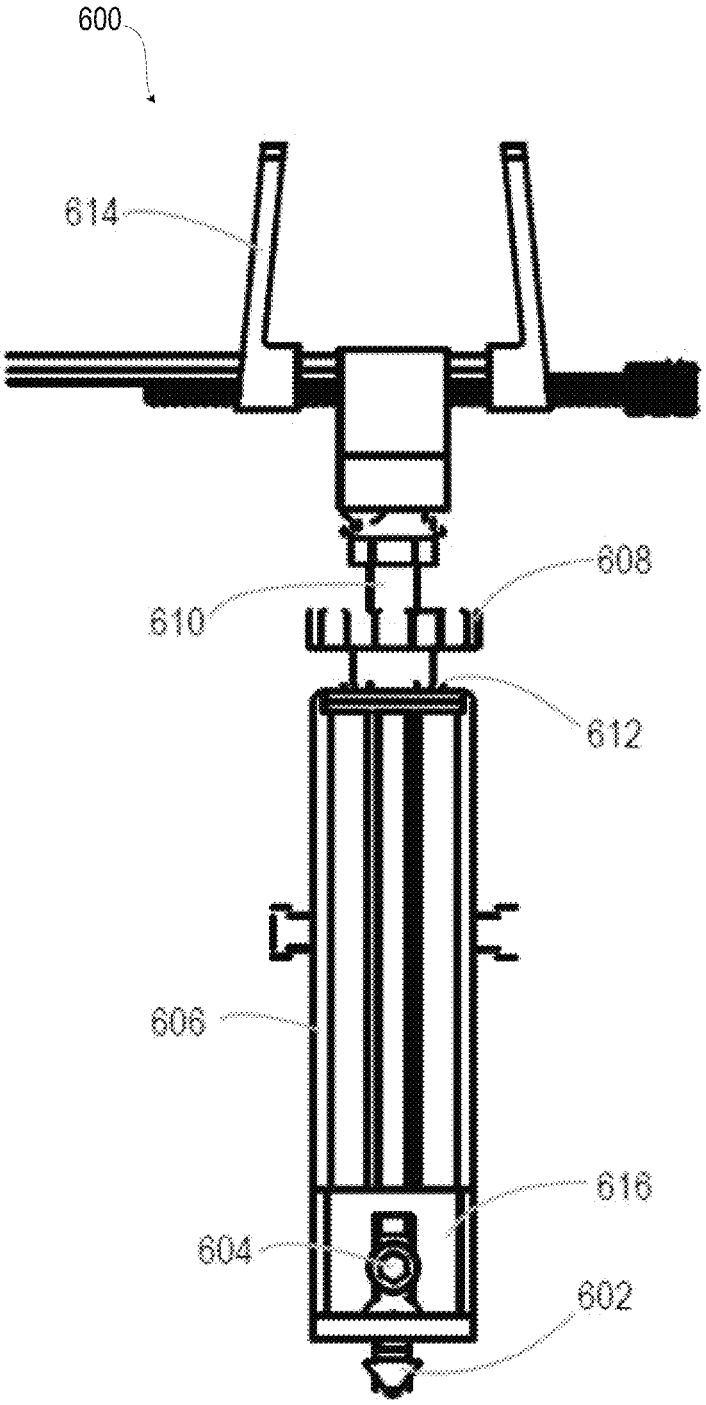
FIG. 6 is illustrative of a forend assembly of a system, according to one or more embodiments.

Referring now to FIG. 6, the system 100 further comprises a forend assembly 600 which is operably connected to the longitudinal rail assembly 208 of base assembly 200. The forend assembly 600 comprises a corner brace 616 affixed to an upright forend tower 606 using a plurality of nuts 602 and 604 and socket head cap screws. The upright forend tower 606 is operably connected to a forend cradle clamp mechanism 614 using an adjusting rod 610, washer 612, and end cap 608. The forend cradle clamp mechanism 614 may be adjusted as necessary to accommodate a wide variety of different firearms.

Figure 7:
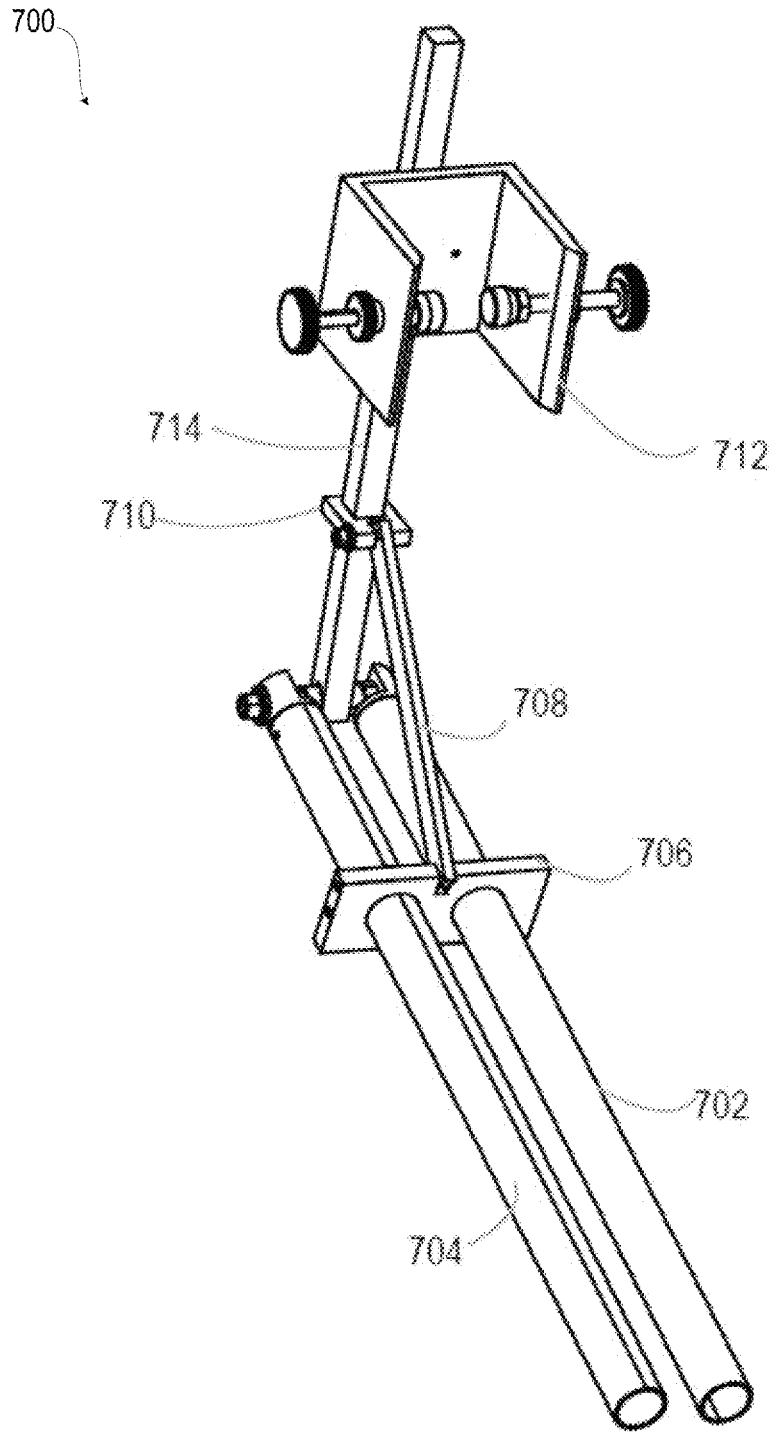
FIG. 7 is illustrative of a stock cradle assembly of a system, according to one or more embodiments.

The system 100 further comprises a stock assembly 700, illustrated by FIG. 7, which is operably connected to the longitudinal rail assembly 208 of base assembly 200. The stock cradle assembly 700 comprises a first extension tube 702 and a second extension tube 704 coupled using a plate 706 and link base 708 to a brace 714 via lock assembly 710. A stock cradle 712 is affixed to the brace 714 using a mounting mechanism. The stock cradle may comprise one or more swivel pads and thumb screws that can be adjusted to accommodate a wide variety of different firearm stocks. In one embodiment a Rosetta joint may be used to affix the brace 714 to the first and second extension tubes 702 and 704 respectively, to provide a means for further adjusting the stock cradle assembly in detent/positive-locking and rotational positions to accommodate a wide variety of different firearm stocks.

Figure 8:
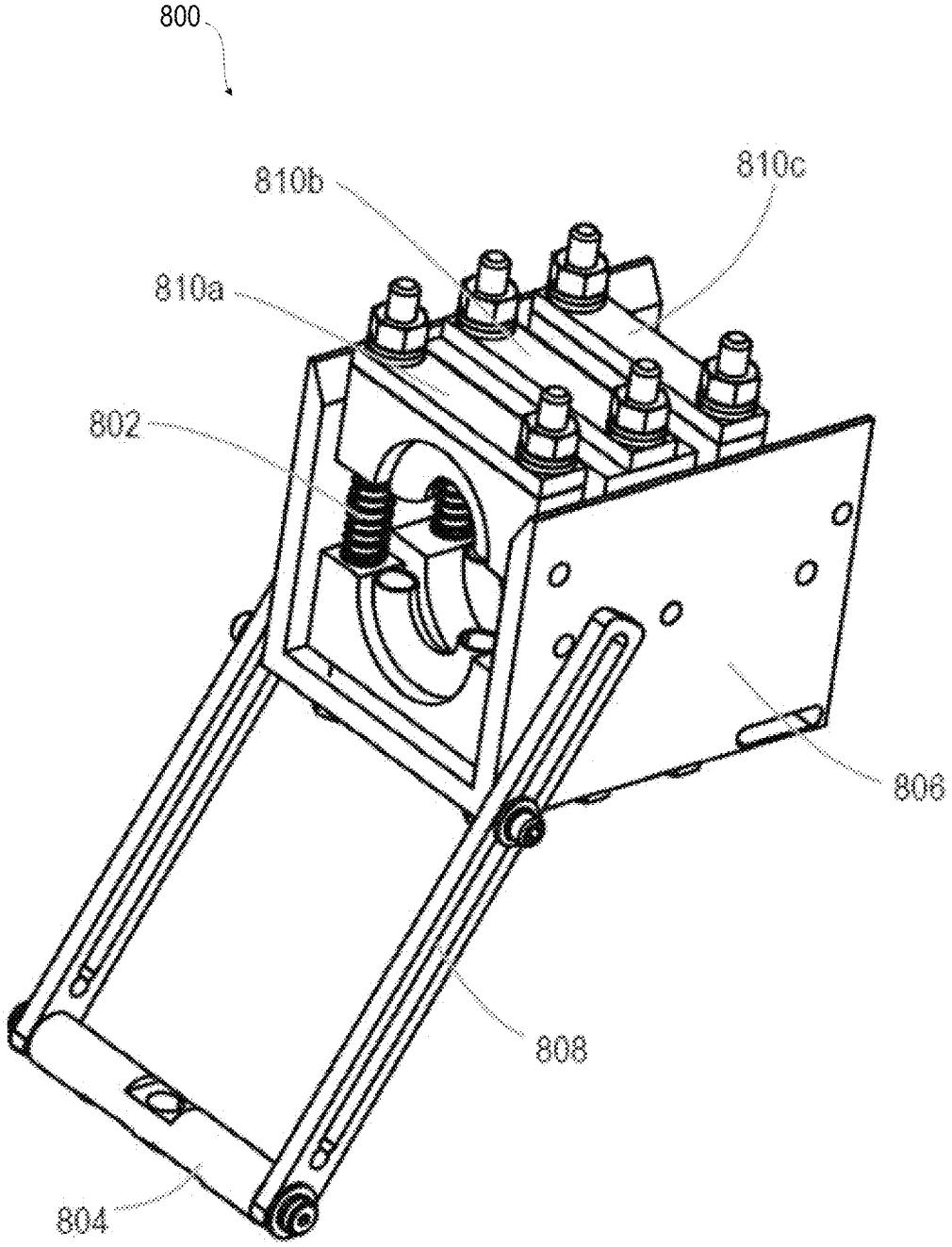
FIG. 8 is illustrative of a grip cradle assembly of a system, according to one or more embodiments.
Figure 9:
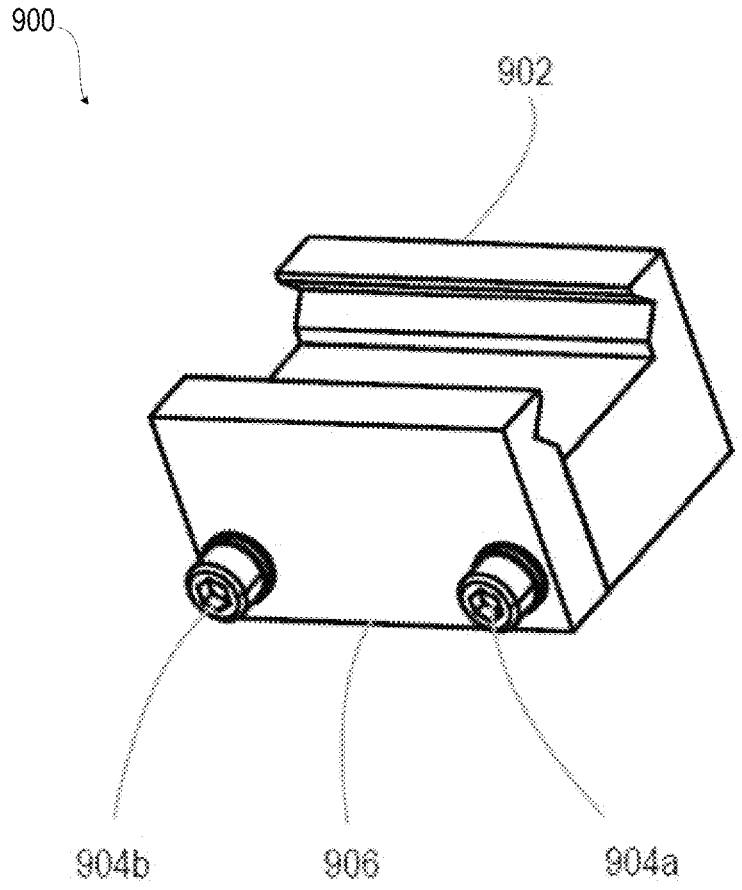
FIG. 9 is illustrative of a Picatinny-style mount of a system, according to one or more embodiments.

FIG. 8 is illustrative of a grip cradle subassembly 800 which is operably connected to the adjustable upright grip/trigger tower 412. The grip cradle subassembly 800 further comprises a support axle 804 connected to two side supports 808. Each side support 808 is affixed to a grip cradle 806 which is configured to house a plurality of clamps 810*a*, 810*b*, and 810*c* to conform to and accommodate a wide variety of firearm grips. Each clamp further comprises one or more springs 802. FIG. 9 is illustrative of a Picatinny-style mount 900 comprising block 902 affixed to a locking plate 906. The locking plate is affixed to the block 902 using a plurality of washers and screws 904*a* and 904*b*. This mount can be affixed to adjustable upright forend tower 606 and used alternatively in place of/instead of forend cradle clamp mechanism 614.

Figure 10:
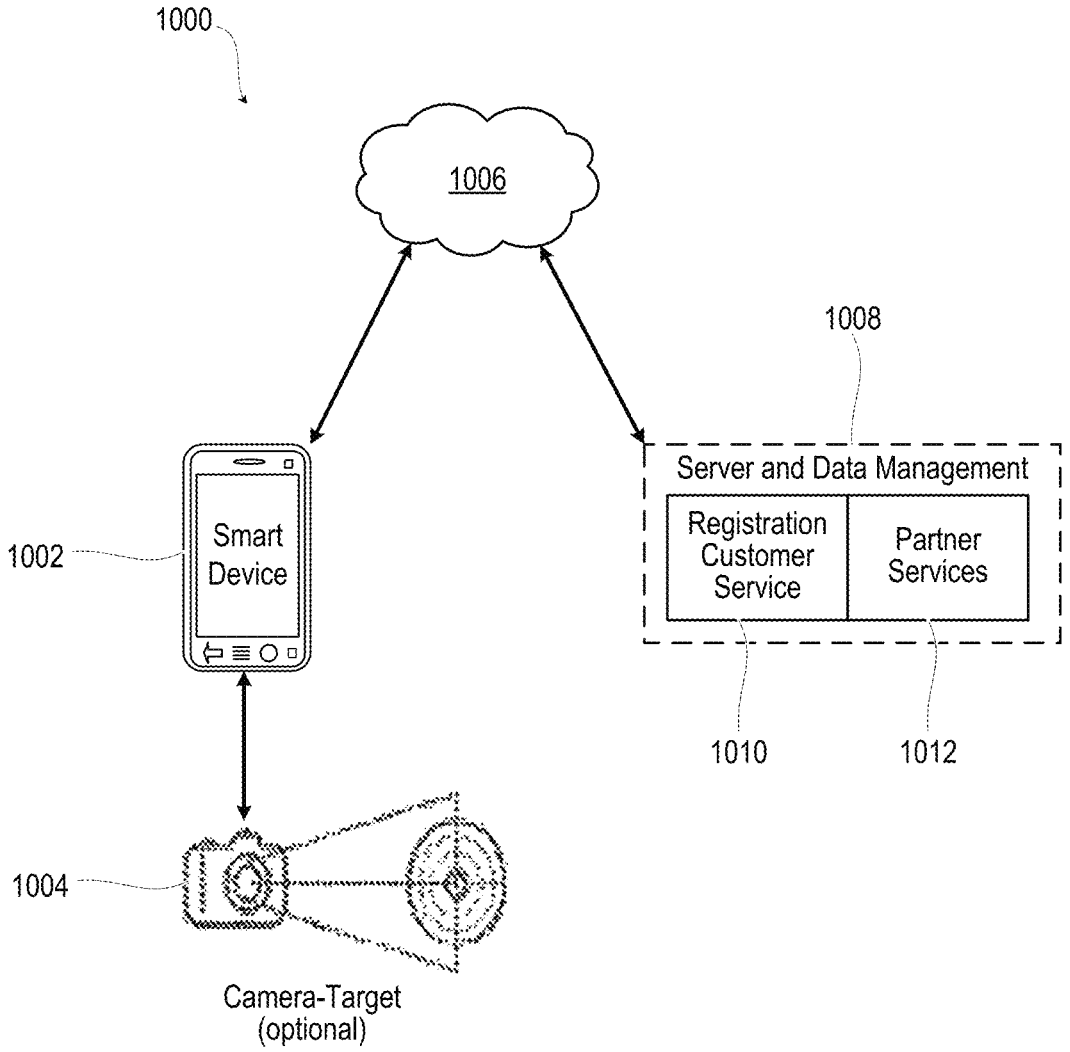
FIG. 10 is illustrative of a data collection environment, according to one or more embodiments.

The present disclosure also provides for a system 1000. This ecosystem is illustrated by FIGS. 10-13. Turning first to FIG. 10, which illustrates on embodiment of the ecosystem, the system 1000 comprises an operator device 1002 configured to receive and transmit one or more data sets over a network 1006 and a server and data management module 1008 also configured to receive one or more data sets over a network. The service and data management module 1008 further comprises a registration customer service submodule 1010 and a partner services submodule 1012. The registration customer service submodule 1010 may be used to collect and transmit data from the operator and the partner services submodule 1012 may be used to collect and transmit data from one or more industry partners. In one embodiment the system 1000 further comprises a camera target 1004 configured to interact with the operator device 1002.

Figure 11:
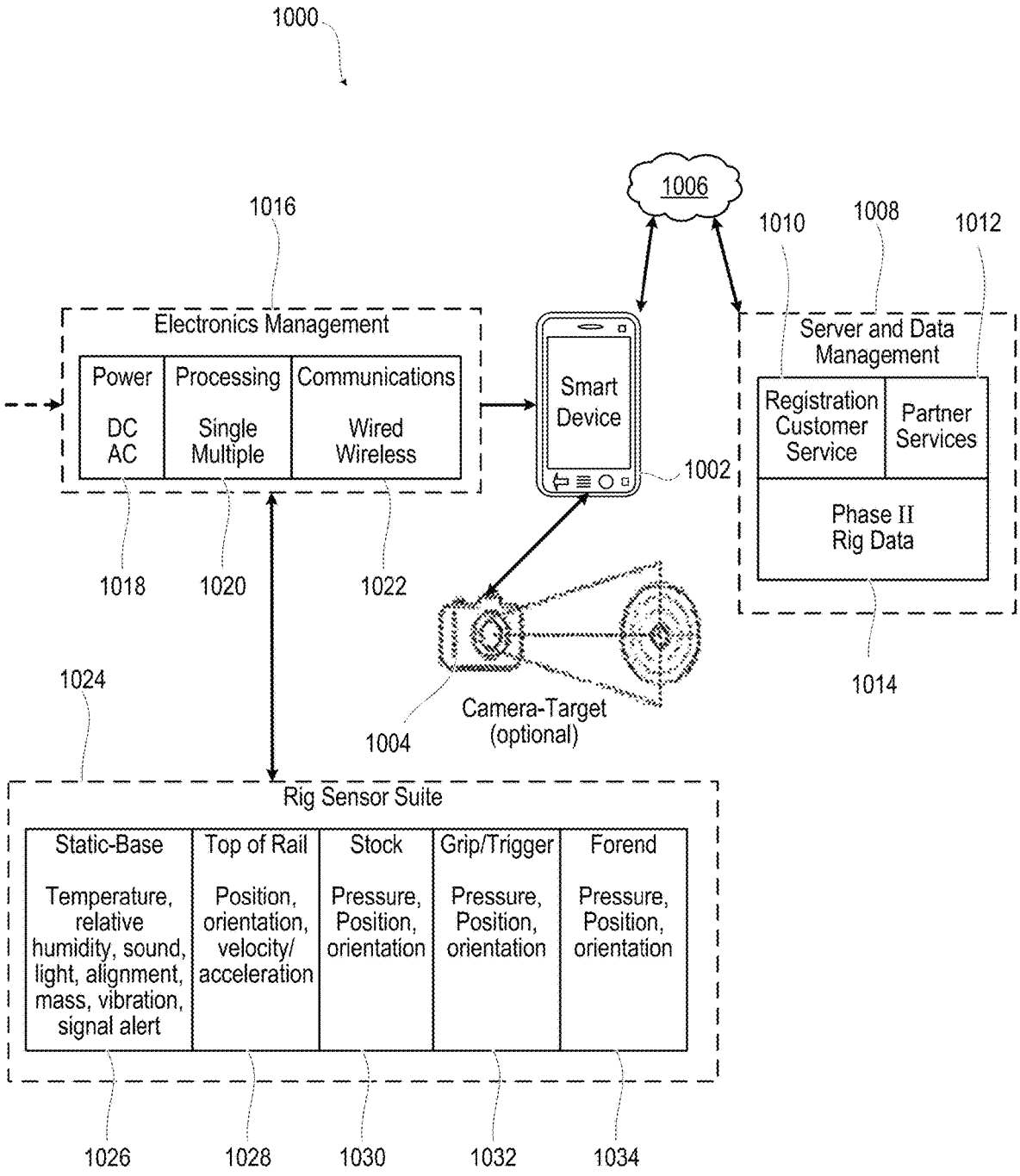
FIG. 11 is illustrative of a data collection environment, according to one or more embodiments.

In another embodiment, illustrated by FIG. 11, the system 1000 further comprises an electronics management module 1016 which comprises a power source 1018, a processor 1020, and a communications submodule 1022. The system 1000 also comprises a rig sensor suite 1024 comprising a plurality of sensors affixed to at least one of an operator and a rig, where the rig sensor suite is operably coupled to the electronics management module 1016 and is configured to collect one or more data sets from at least one of the operator via the operator device 1002 and the rig. The rig sensor suite 1024 further comprises a plurality of different sensors including: (1) a-base sensor 1026 configured to receive one or more data sets associated with at least one of temperature, relative humidity, sound, light, alignment, mass vibration, signals, and alerts; (2) a top of rail sensor 1028 configured to receive one or more data sets associated with at least one of position, orientation, velocity, and acceleration; (3) a stock sensor 1030 configured to receive one or more data sets associated with at least one of pressure, position, and orientation; (4) a grip trigger sensor 1032 configured to receive one or more data sets associated with pressure, position, and orientation, and a forend sensor 1034 configured to receive one or more data sets associated with at least one of pressure, position, and orientation. In the embodiment of FIG. 11, the server and data management module 1008 may further comprise a rig data submodule 1014 configured to process one or more data sets received from the rig sensor suite.

Figure 12:
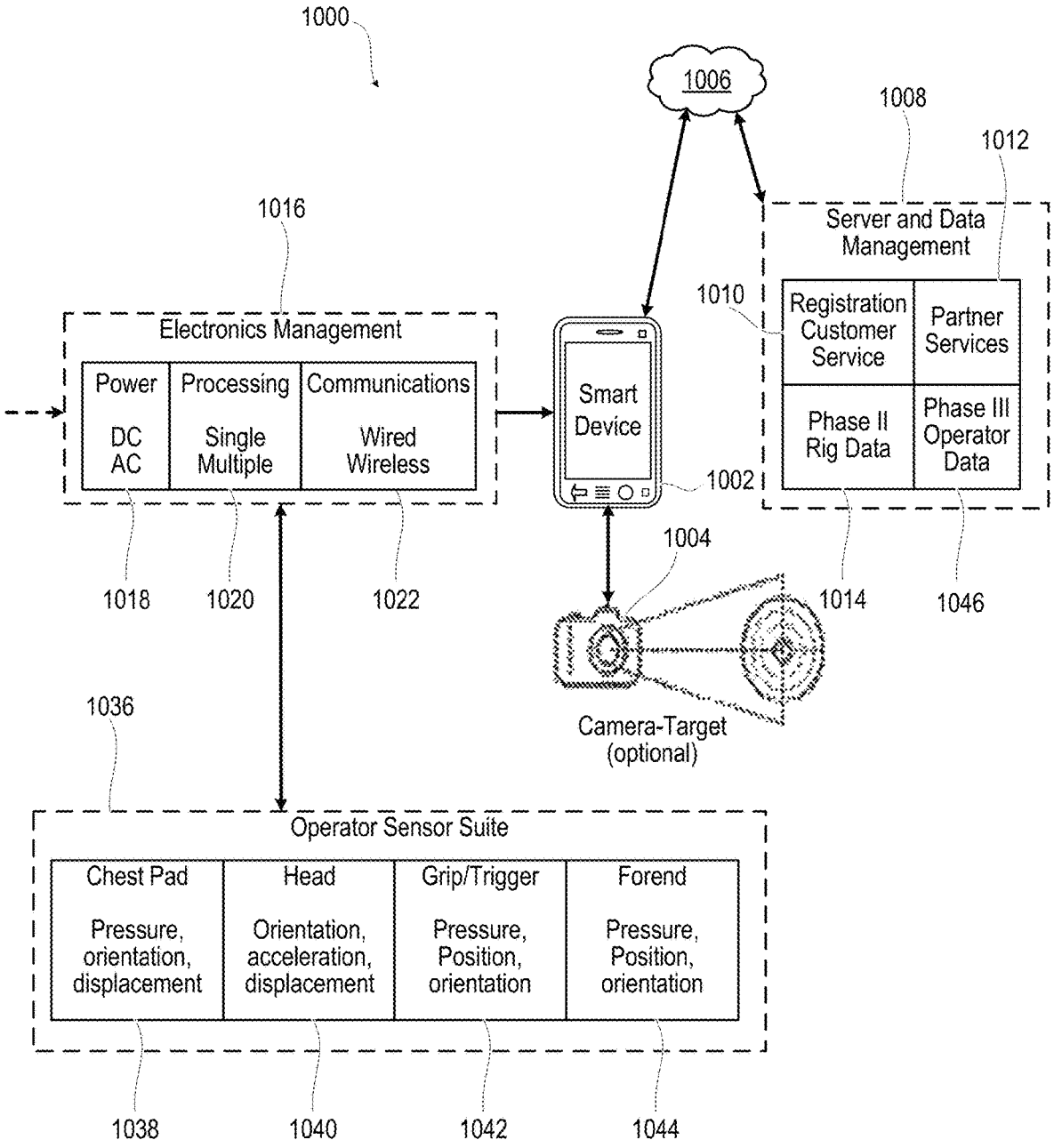
FIG. 12 is illustrative of a data collection environment, according to one or more embodiments.

In another embodiment, illustrated by FIG. 12, the system 1000 further comprises an operator sensor suite 1036, where the operator sensor suite 1036 further comprises a plurality of different sensors including: (1) a chest pad sensor 1038 configured to receive one or more data sets associated with at least one of pressure, orientation, and displacement; (2) a head sensor 1040 configured to receive one or more data sets associated with at least one of orientation, acceleration and displacement; (3) a grip trigger sensor 1042 configured to receive one or more data sets associated with at least one of pressure, position, and orientation; and (4) a forend sensor 1044 configured to receive one or more data sets associated with at least one of pressure, position, and orientation.

Figure 13:
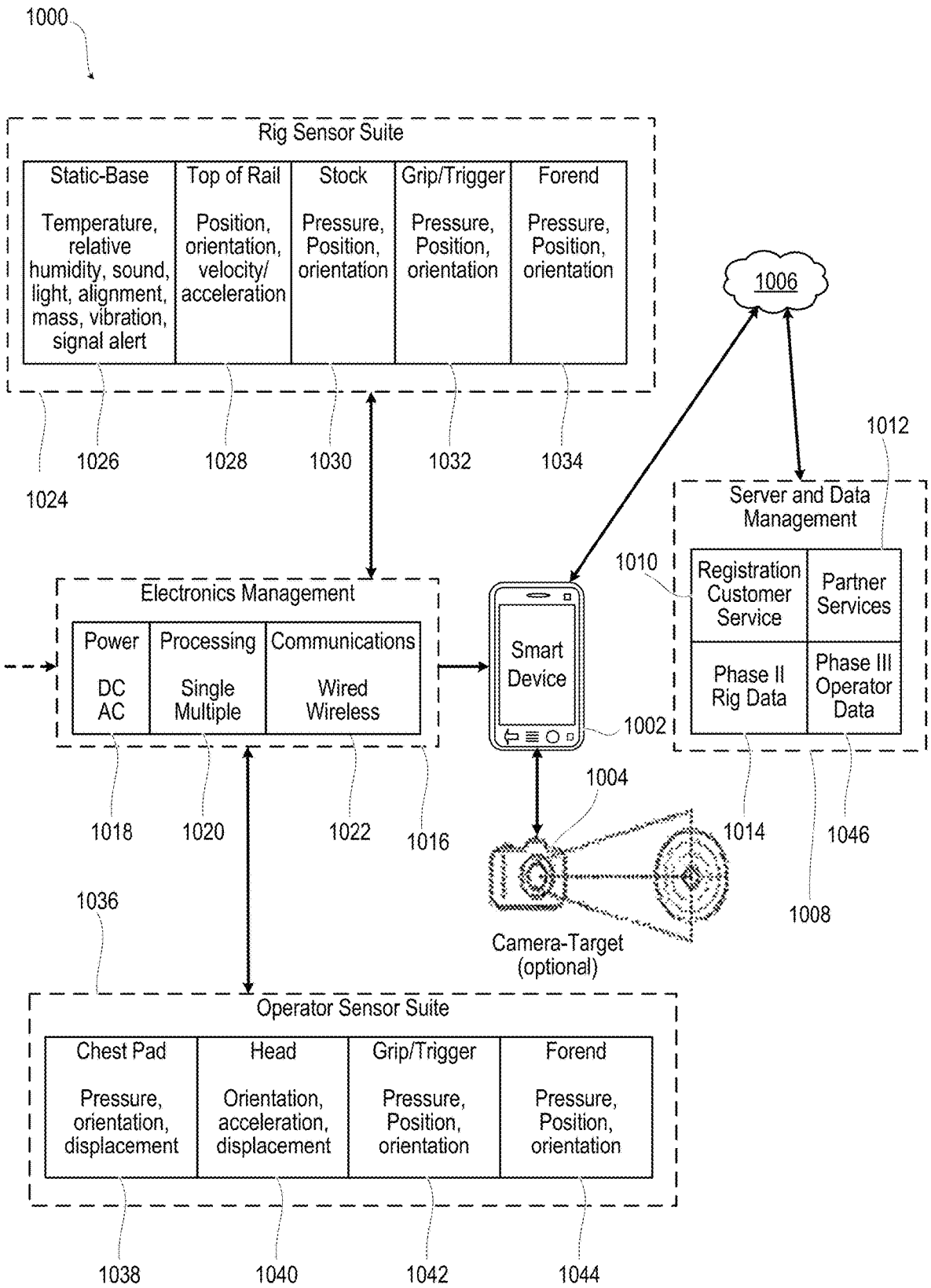
FIG. 13 is illustrative of a data collection environment, according to one or more embodiments.

In another embodiment, illustrated by FIG. 13, the server and data management module 1008 further comprises an operator data submodule 1046 configured to process one or more data sets received from the operator device 1002. In yet another embodiment, the server and data management module 1008 further comprises comparative data submodule configured to process one or more data sets by applying an algorithm to compare the data sets to one or more baselines.

Figure 14A:
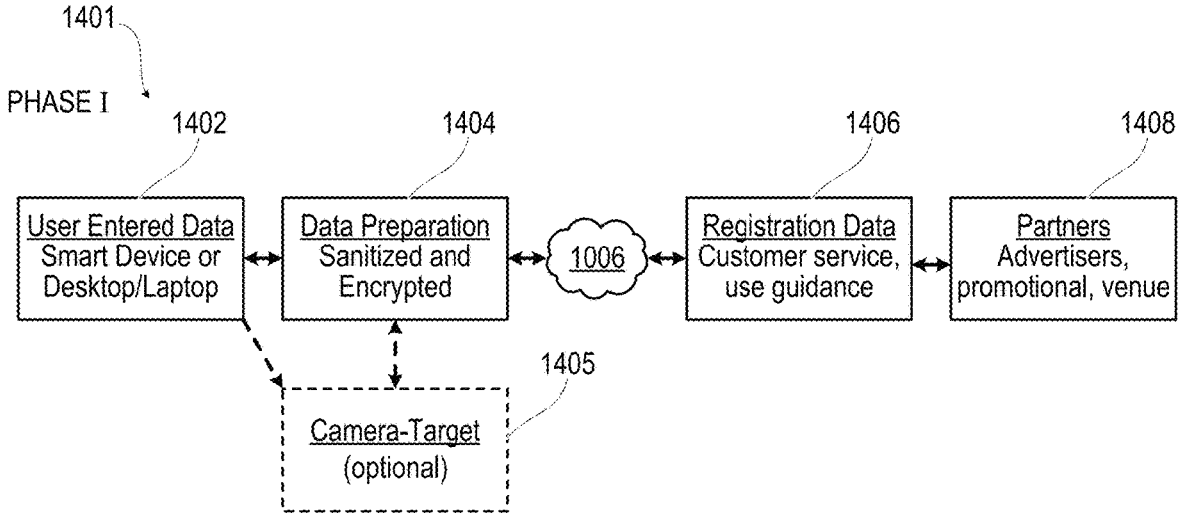
FIGS. 14A-14D are illustrative respectively of a Phase I-IV data collection environments, according to one or more embodiments.

FIGS. 14A-14D are illustrative of a data collection environment of the present disclosure. FIG. 14A is a Phase I of data collection environment 1401 that includes user entered data operation (block 1402). An operator can enter data in block 1402 using an operator device. In one embodiment, the operator device may comprise a smart device or a computer such as a desktop or laptop. This operator data may be sanitized and encrypted at the data preparation block 1404. In one embodiment, data may also be collected and transmitted using a camera target block 1405, but such use is not required. Once the data is prepared at block 1404, the data is transmitted over a network 1006 with registration data (block 1406) such as customer service, use guidance, etc. Partners (block 1408) such as advertisers, promotional entities, venue managers, etc., may also communicatively coupled via network 1006.

Figure 14B:
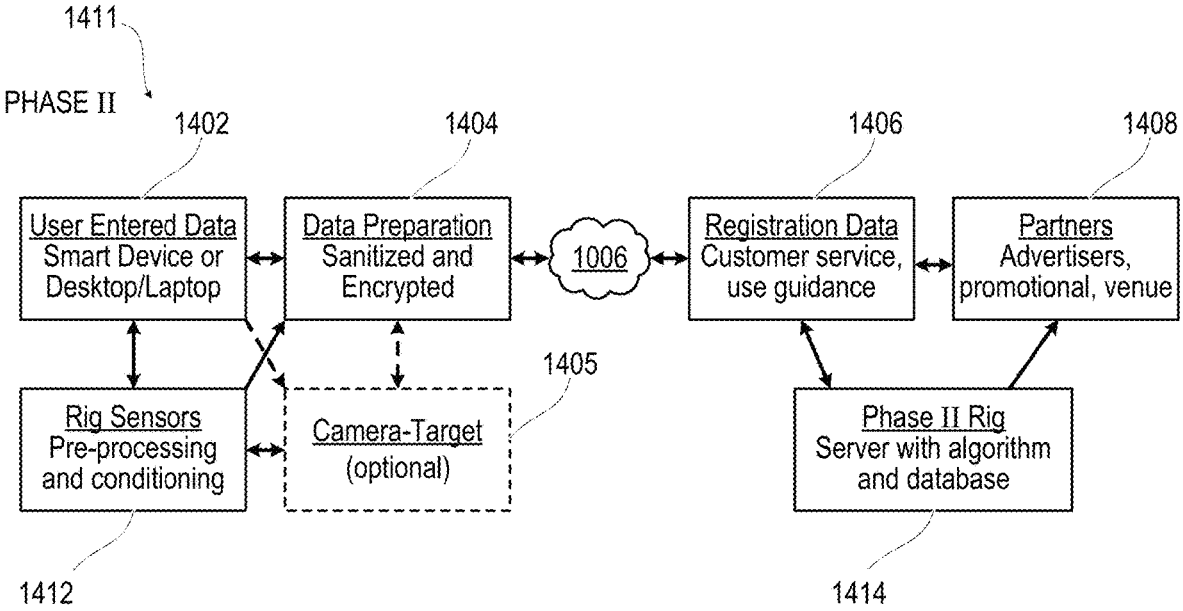

FIG. 14B is a Phase II data collection environment 1411 that includes the features of Phase I data collection environment 1401 (FIG. 14A). Rig sensors (block 1412) does pre-processing and conditioning of sensor data and communicatively coupled to blocks 1402 and 1404. Phase II Rig server (block 1414) provides an algorithm and database and is communicatively coupled to blocks 1406 and 1408.

Figure 14C:
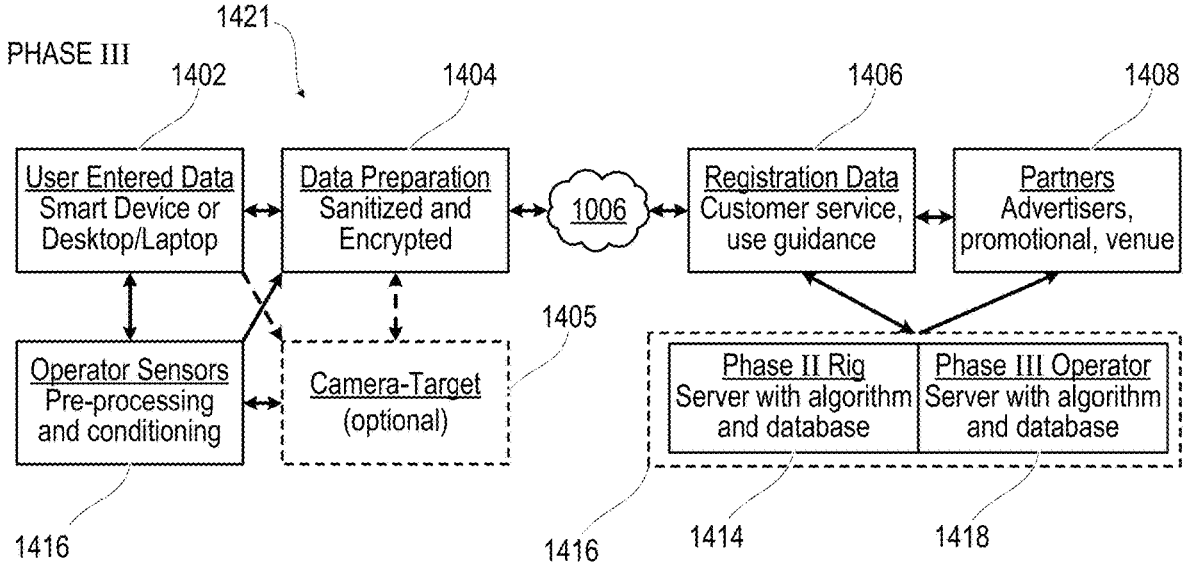

FIG. 14C is a Phase III data collection environment 1421 that includes the features of Phase II data collection environment 1411 (FIG. 14B). Instead of rig sensors (block 1412 of FIG. 14B) operator sensors (block 1416) does pre-processing and conditioning of sensor data and is communicatively coupled to blocks 1402, 1404 and 1405. Phase III backend system 1416 includes Phase II Rig server (block 1414) and Phase III operator server (block 1418) that provide an algorithm and database and are communicatively coupled to blocks 1406 and 1408.

Figure 14D:
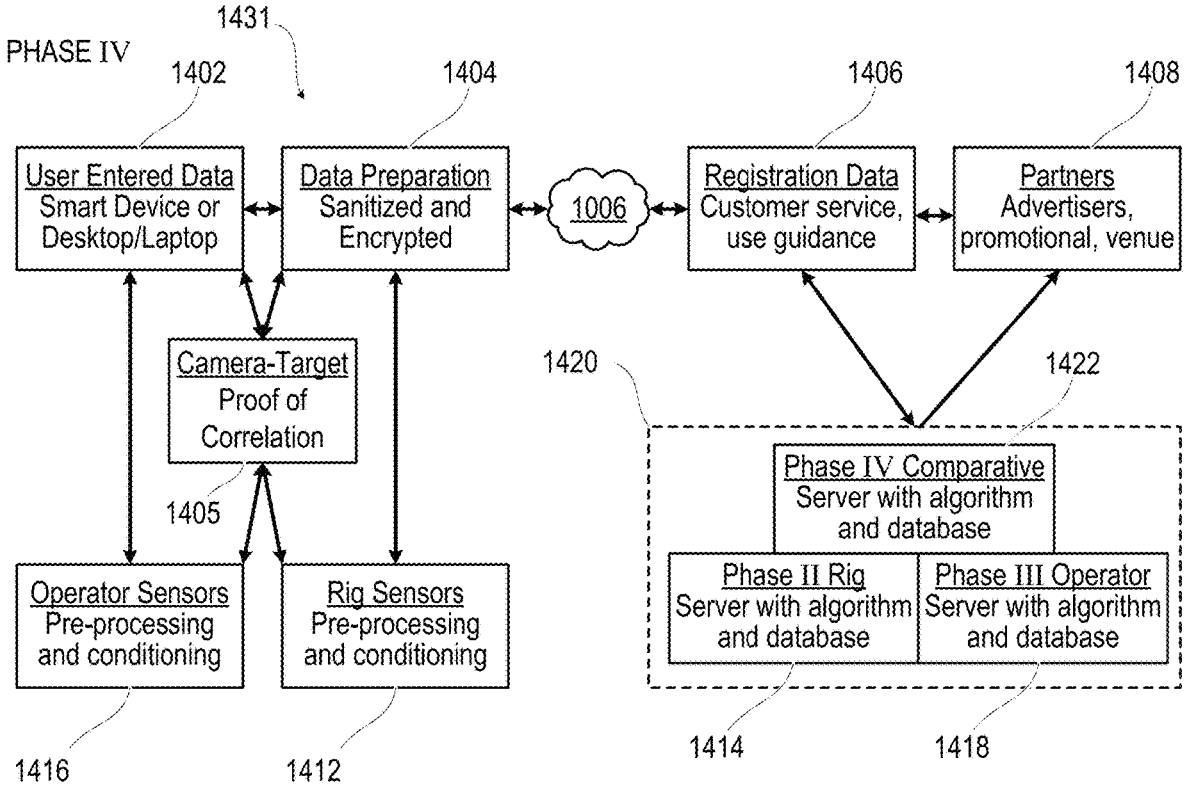

FIG. 14D is a Phase IV data collection environment 1431 that includes the features of Phase III data collection environment 1421 (FIG. 14C). Operator sensors (block 1416) are communicatively coupled to blocks 1402, 1404 and 1405. Rig operator sensors (block 1412) are communicatively coupled to blocks 1404 and 1405. Phase IV backend system 1420 includes Phase II Rig server (block 1414), Phase III operator server (block 1418), and Phase IV comparative server (block 1422) that provide an algorithm and database and are communicatively coupled to blocks 1406 and 1408.

In alternative embodiments, additional data sets may be collected and transmitted using a plurality of rig sensors (block 1412) and operator sensors (block 1416). Registration data (block 1406), data collected from industry partners 1408, and data from a plurality of rig sensors may also be collected and transmitted via the network 1006 to the operator. Combined rig sensors 1412 and operator sensors 1416 may also be implemented on one embodiment. Comparative data from block 1422 may also be used in analyzing data obtained from an operator and/or a rig to determine thresholds and baselines relevant for providing performance feedback to the operator. There are a couple options for using comparison data: Assist operator to determine if they are performing better or worse relative to previous times; Assist operator to compare their performance to other operators using various categories such as demographic, firearm, distance, etc.

Shooting Rest Stabilizer

Figure 15:
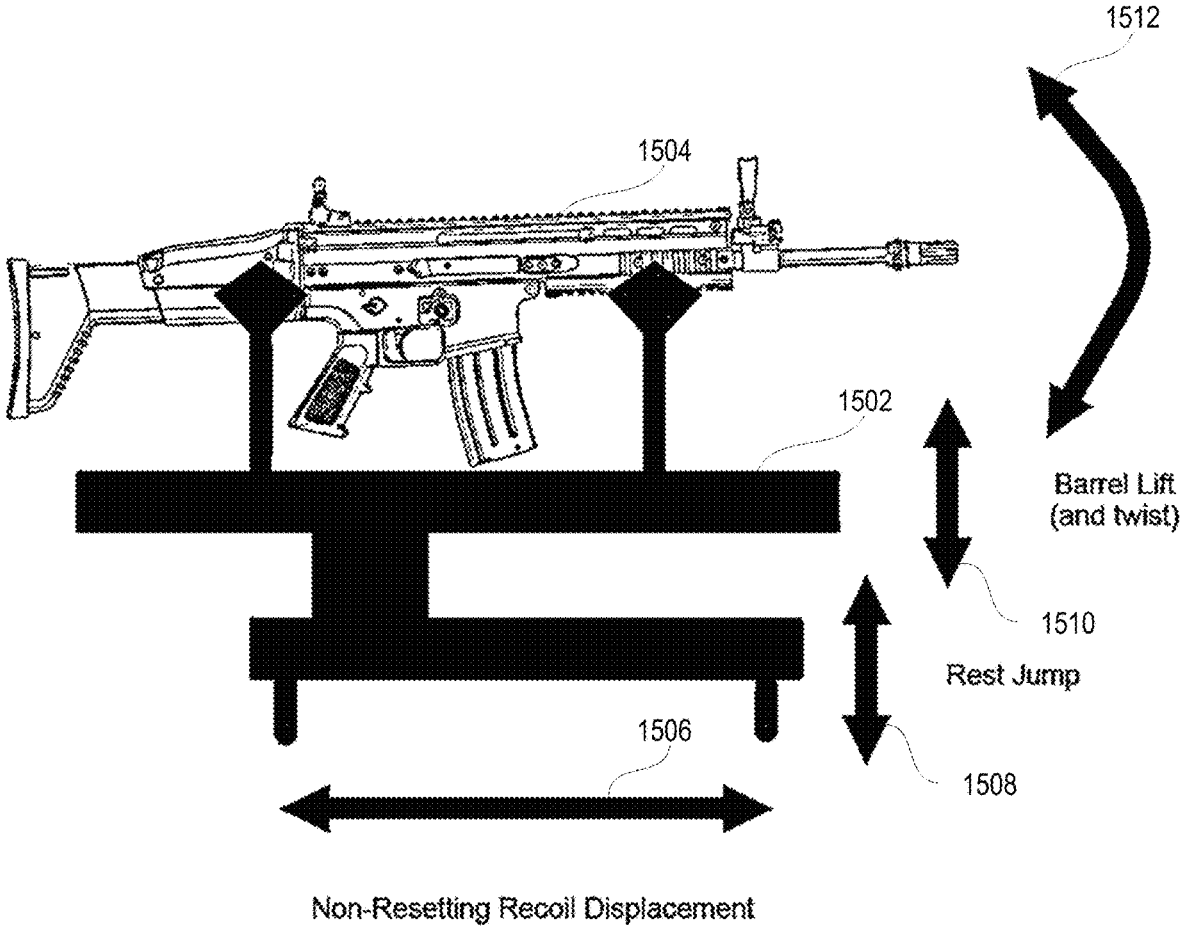
FIG. 15 (prior art)
FIG. 15 is a side view of the conventional shooting rest that is annotated with movement that occurs without stabilization.

FIG. 15 is a side view of a conventional shooting rest 1502 that is annotated with undesirable movement that occurs without stabilization. It is common for the shooting rest 1502 without benefit of the present disclosure to provide undesirable movement, affecting the operational physics of the weapon 1504, thereby compromising performance (defined as repeatable precision). In an example, the shooting rest 1502 may longitudinally displace as "non-resetting recoil displacement" as depicted at arrow 1506. The distal end of the shooting rest 1502 may experience a rest jump as depicted at arrow 1508. The barrel of the weapon 1504 may experience a barrel lift as depicted at arrow 1510. The barrel of the weapon may experience a twist within the shooting rest 1502 as depicted at 1512.

Figure 16:
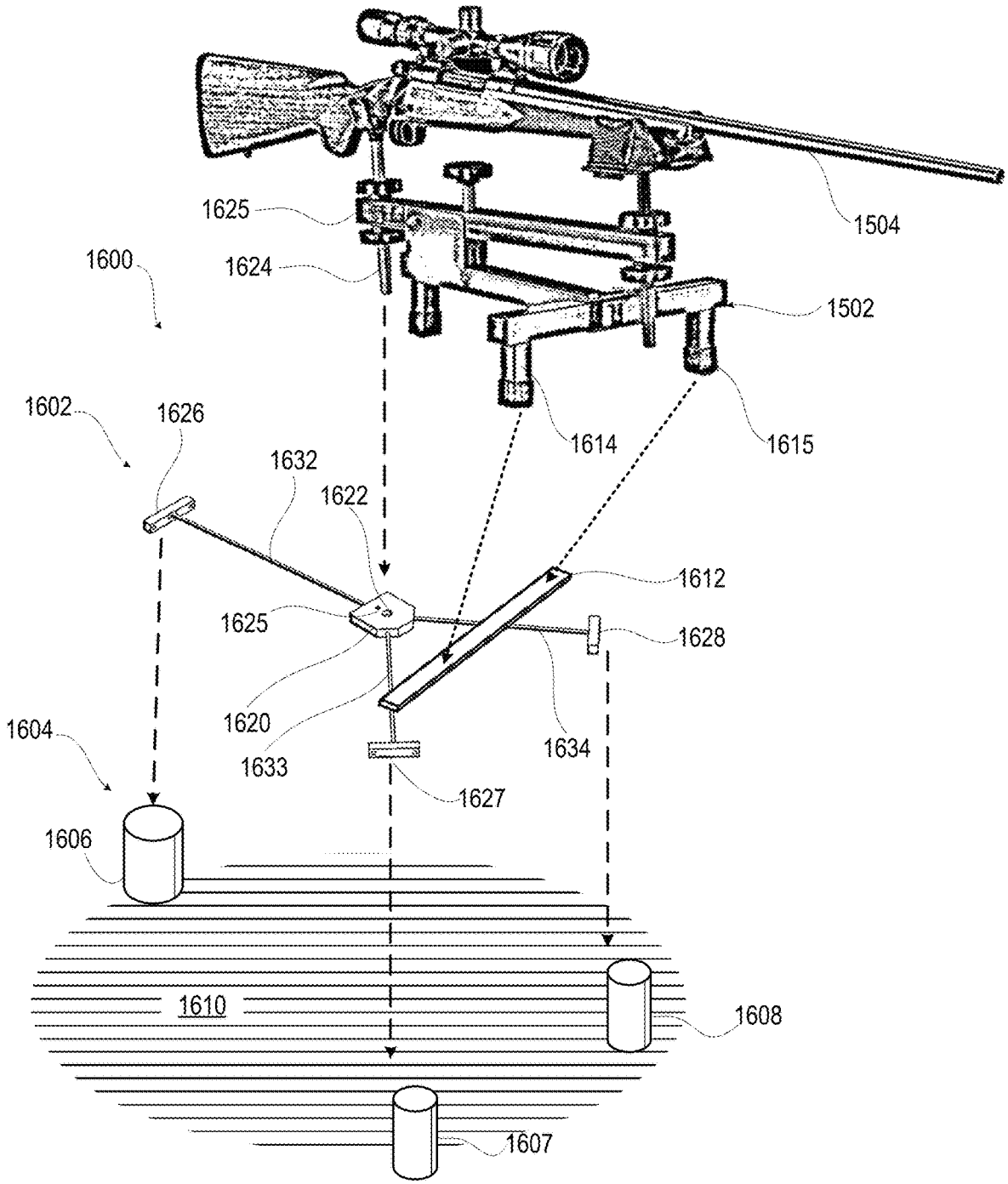
FIG. 16 is an isometric exploded view of a shooting rest stabilizer below a rifle on a shooting rest and above a shooting rest mount, according to one or more embodiments.

FIG. 16 is an isometric exploded view of a stabilized shooting rest system 1600 that includes a shooting rest stabilizer 1602 above a shooting rest mount assembly 1604. When assembled, the shooting rest stabilizer 1602 stabilizes the shooting rest 1502 to the shooting rest mount assembly 1604. In particular, the shooting rest stabilizer is configured to resist movement of the shooting rest 1502 in response to firing of a firearm or weapon (1504) supported by the shooting rest 1502. The shooting rest mount assembly 1604 includes a back support 1606, a front right support 1607 and a front left support 1608, at least one of which are individually or collectively secured to a stationary ground surface 1610 to form a supporting assembly. In alternate embodiments described below, a shooting rest mount assembly includes structures connecting the back support 1606, the front right support 1607 and the front left support 1608 to create a unitary supporting platform. A front lateral fixture 1612 of the stabilized shooting rest system 1600 is coupled directly or indirectly to the front right and left supports 1607 and 1608 to support front right leg 1614 and front left leg 1615 of the shooting rest 1502.

Figure 17A:
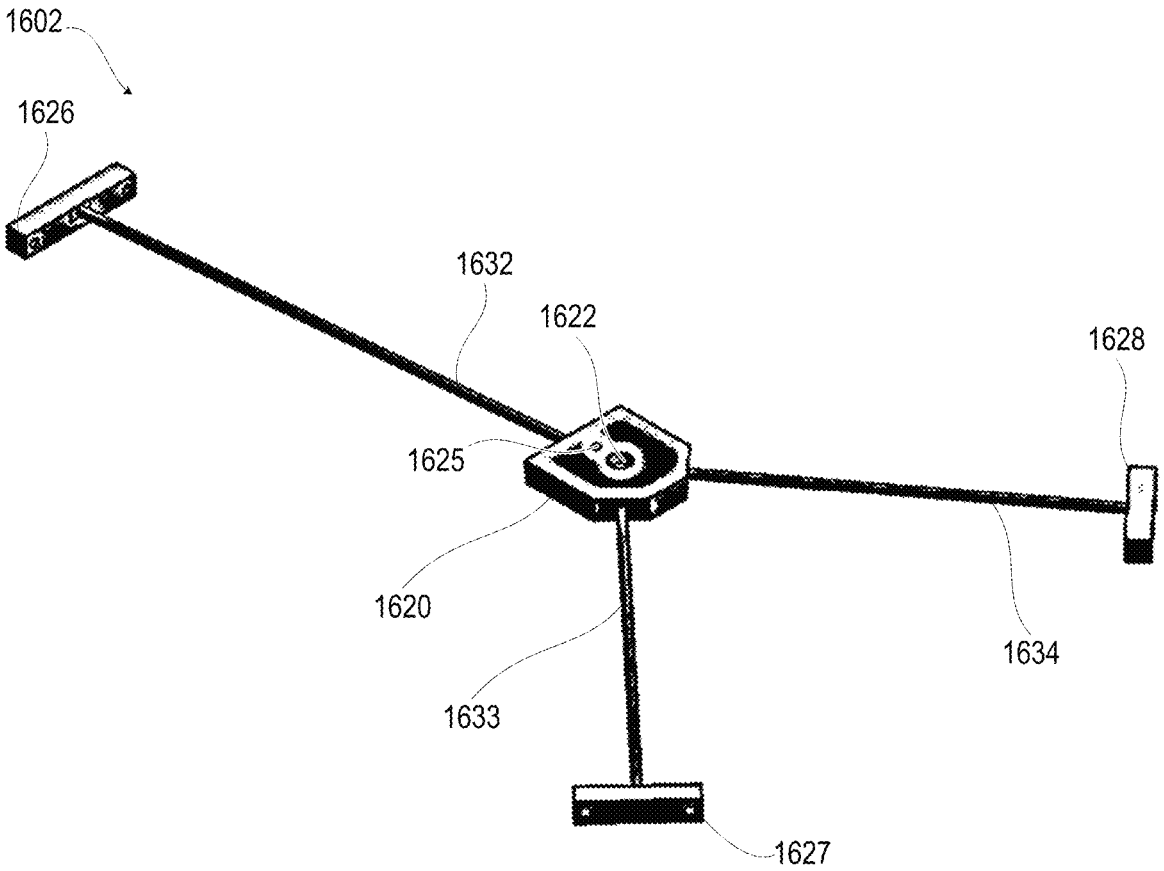
FIGS. 17A-17C are isometric, top, and side views of the shooting rest stabilizer of FIG. 16, according to one or more embodiments.
Figure 17B:
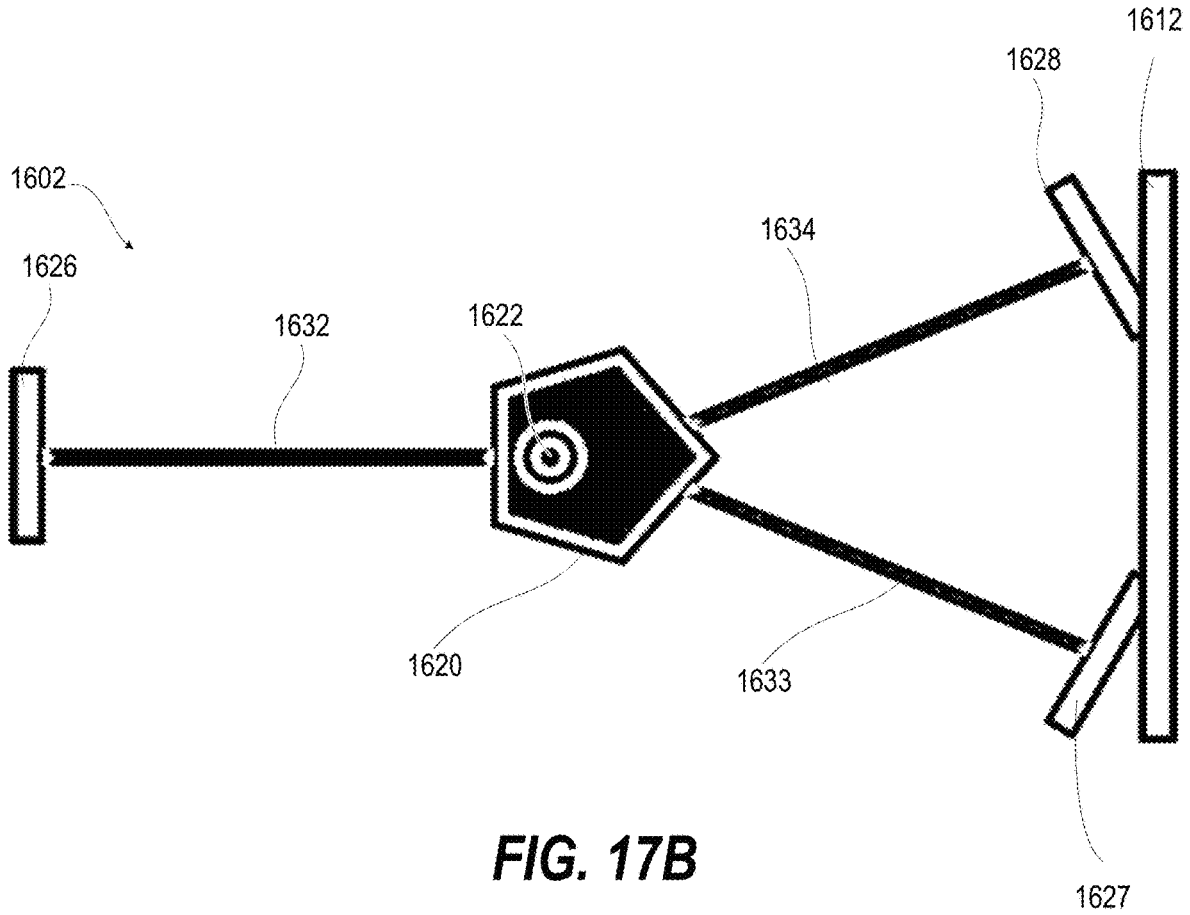
Figure 17C:
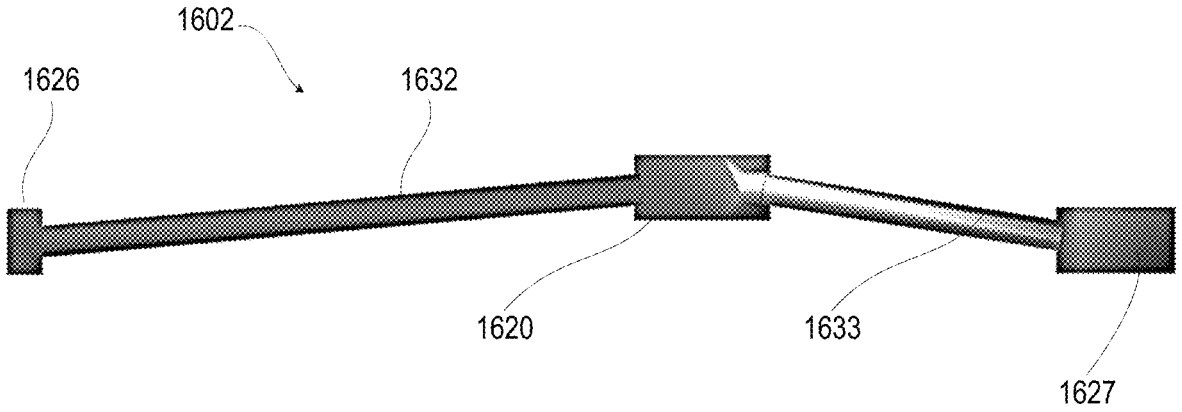

FIGS. 17A-17C are isometric, top, and side views of the shooting rest stabilizer 1602 of FIG. 16. With particular reference to FIG. 16, the shooting rest stabilizer 1602 includes a base plate 1620 having an orifice 1622 provide a rear attachment mechanism of the shooting rest stabilizer 1602 configured to receive a downward projecting rear adjustment bolt or leg 1624 of the shooting rest 1502. Legs of the shooting rest 1502 may or may not include a rear adjustment mechanism 1625 for adjustment and any adjustment would be independent of adjustment provided by the shooting rest stabilizer 1602. The base plate 1620 includes an interface mechanism 1625 that is selectively lockable to the adjustment bolt or leg 1624 to allow for vertical adjustment of the adjustment bolt or leg 1624. The shooting rest stabilizer 1602 includes a back mounting block 1626 engageable to a back support 1606. The shooting rest stabilizer 1602 includes a front right mounting block 1627 engageable to a front right support 1607. The shooting rest stabilizer 1602 includes a front left mounting block 1628 engageable to a front left support 1608. In one or more embodiment, the back support 1606, the front right support 1607 and the front left support 1608 are individually or collectively securable to a stationary ground surface 1610. The shooting rest stabilizer 1602 includes a back elongate support 1632 attached between a rear edge of the base plate 1620 and the back mounting block 1626. The shooting rest stabilizer 1602 includes a front right elongate support 1633 attached between a front right edge of the base plate 1620 and the front right mounting block 1607. A front left elongate support 1634 is attached between a left front edge of the base plate 1620 and the front left mounting block 1628.

In one or more embodiments, each of the back elongate support 1632, the front right elongate support 1633, and the front left elongate support 1634 of the shooting rest stabilizer 1602 include a length adjustment mechanism that is a linearly expandable and compressible to impart a stabilizing force on the base plate. In one or more alternate embodiments, each of the back elongate support 1632, the front right elongate support 1633, and the front left elongate support 1634 of the shooting rest stabilizer 1602 include a telescoping length adjustment mechanism that is selectively longitudinally adjustable to accommodate spacing between the base plate 1620 and a corresponding one of the back support 1606, the front right support 1607 and the front left support 1608 and selectively engageable to a fixed length for use.

With particular reference to FIG. 17C, in one or more embodiments, each of the back elongate support 1632, the front right elongate support 1633, and the front left elongate support 1634 (FIG. 16) of the shooting rest stabilizer 1602 are at least vertically pivotably attached to the base plate 1620 to facilitate positioning of the base plate 1620 above the back elongate support 1632, the front right elongate support 1633, and the front left elongate support 1634 (FIG. 16) for increased stability.

Figure 18A:
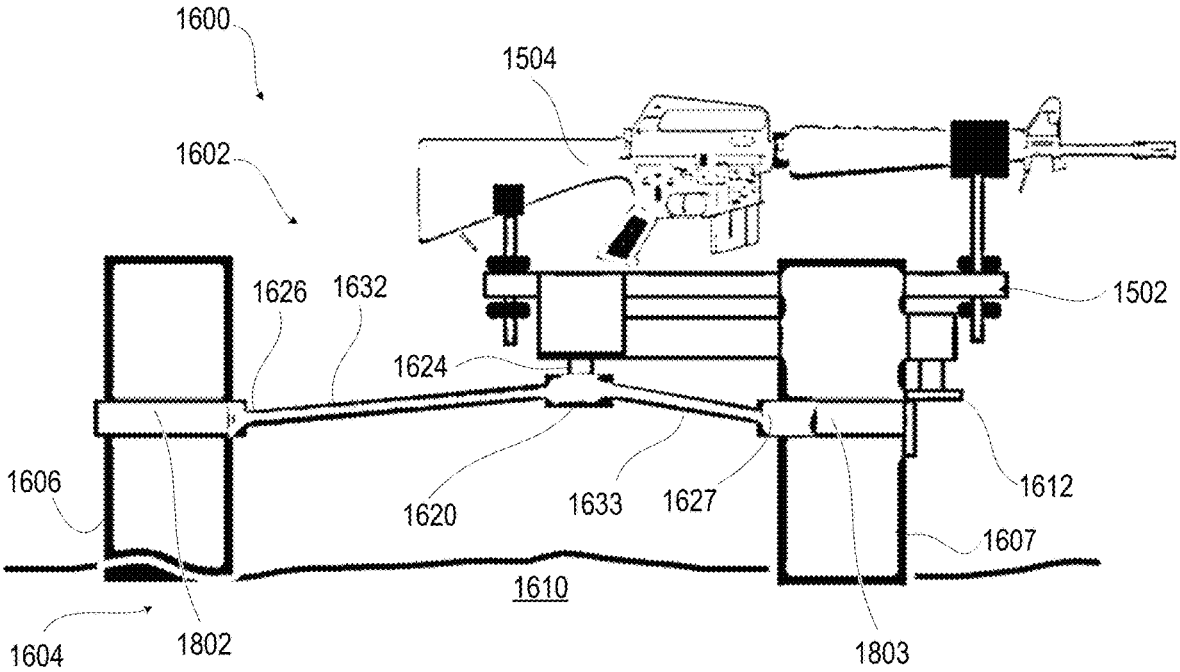
FIGS. 18A-18C are isometric, top, and side views of the shooting rest stabilizer system having the shooting rest stabilizer attached to the shooting rest mount and to the shooting rest of FIG. 16, according to one or more embodiments.
Figure 18B:
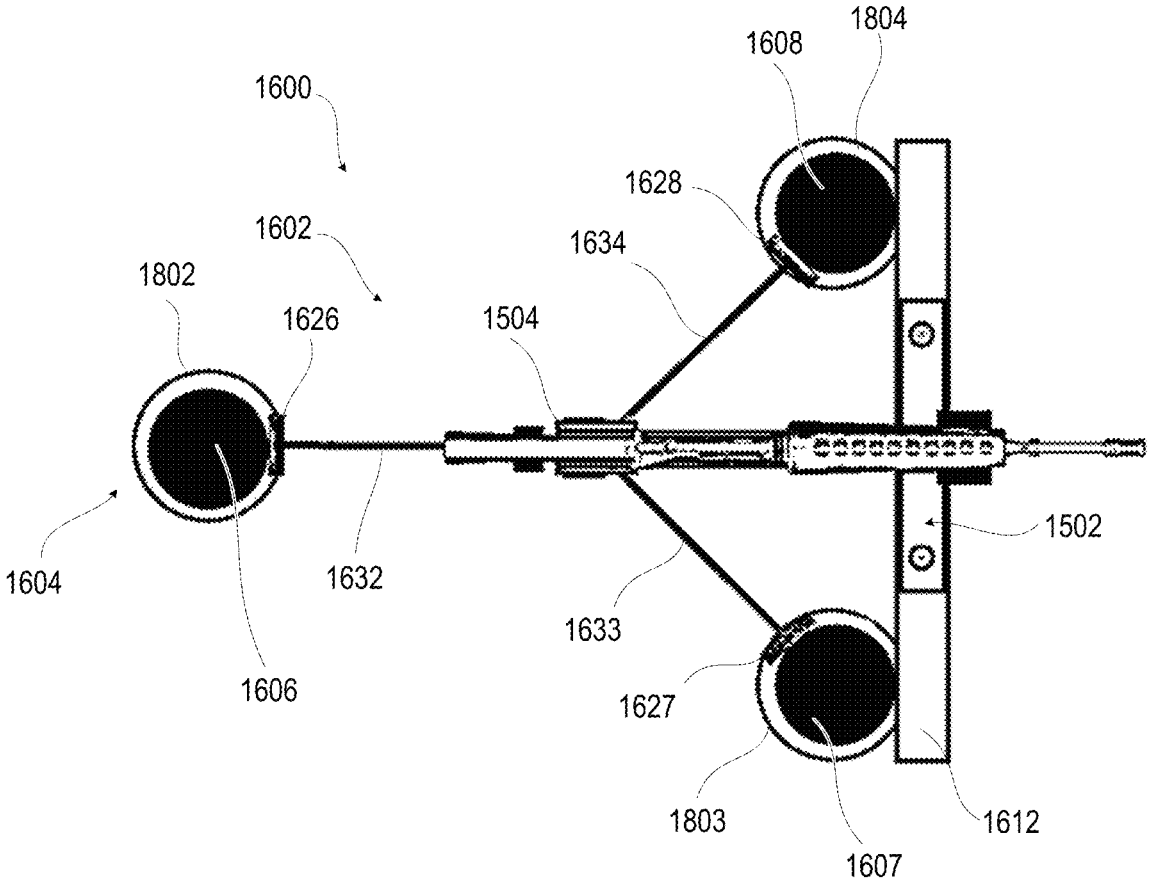
Figure 18C:
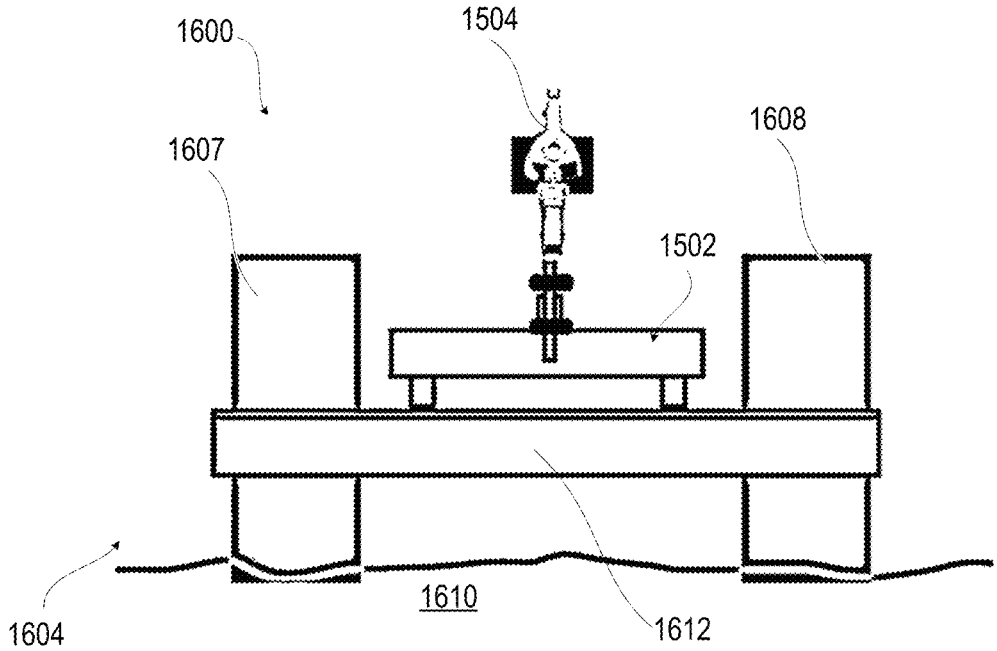

FIGS. 18A-18C are isometric, top, and side views of the stabilized shooting rest system 1600 supporting and stabilizing the shooting rest 1502 of FIG. 16. With particular reference to FIG. 18B, the shooting rest stabilizer 1602 further includes a back clamp 1802 attached to the back mounting block 1626 and vertically adjustable and selectively engageable to the back support 1606 that extends vertically upward. The shooting rest stabilizer 1602 further includes a front right clamp 1803 attached to the front right mounting block 1627 and vertically adjustable and selectively engageable to the front right support that extends vertically upward. The shooting rest stabilizer 1602 further includes a front left clamp 1804 attached to the front left mounting block 1628 and vertically adjustable and selectively engageable to the front left support 1608 that extends vertically upward.

Figure 19:
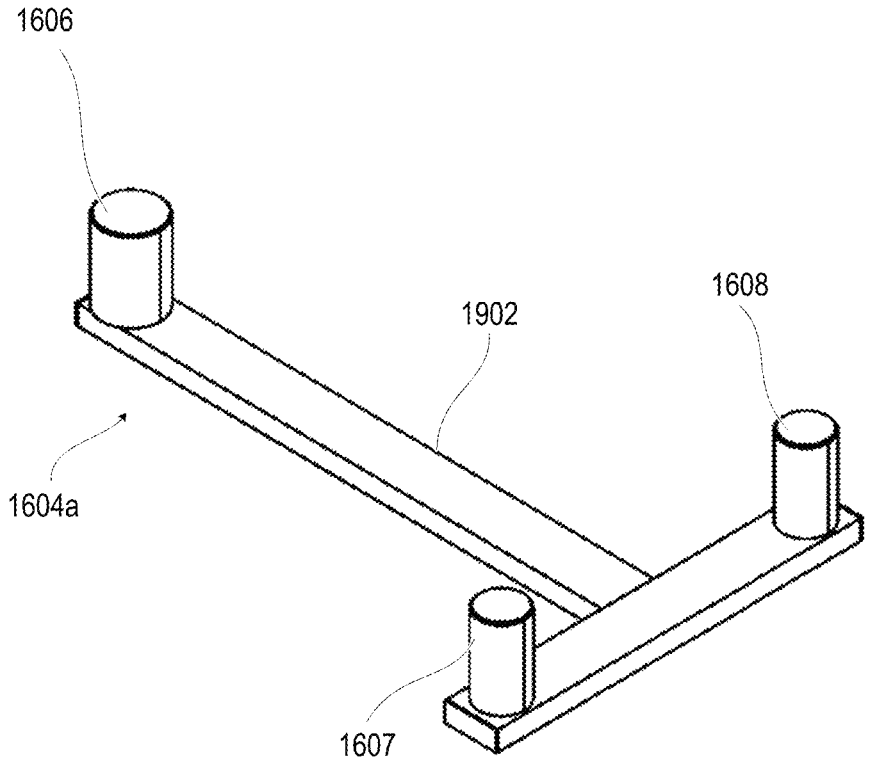
FIG. 19 is an isometric view of an example unitary shooting rest mount, according to one or more embodiments.

FIG. 19 is an isometric view of an example unitary shooting rest mount platform 1604*a* that includes the back support 1606, the front right support 1607 and the front left support 1608 all connected by being attached to a T-shaped connecting structure 1902.

Figure 20:
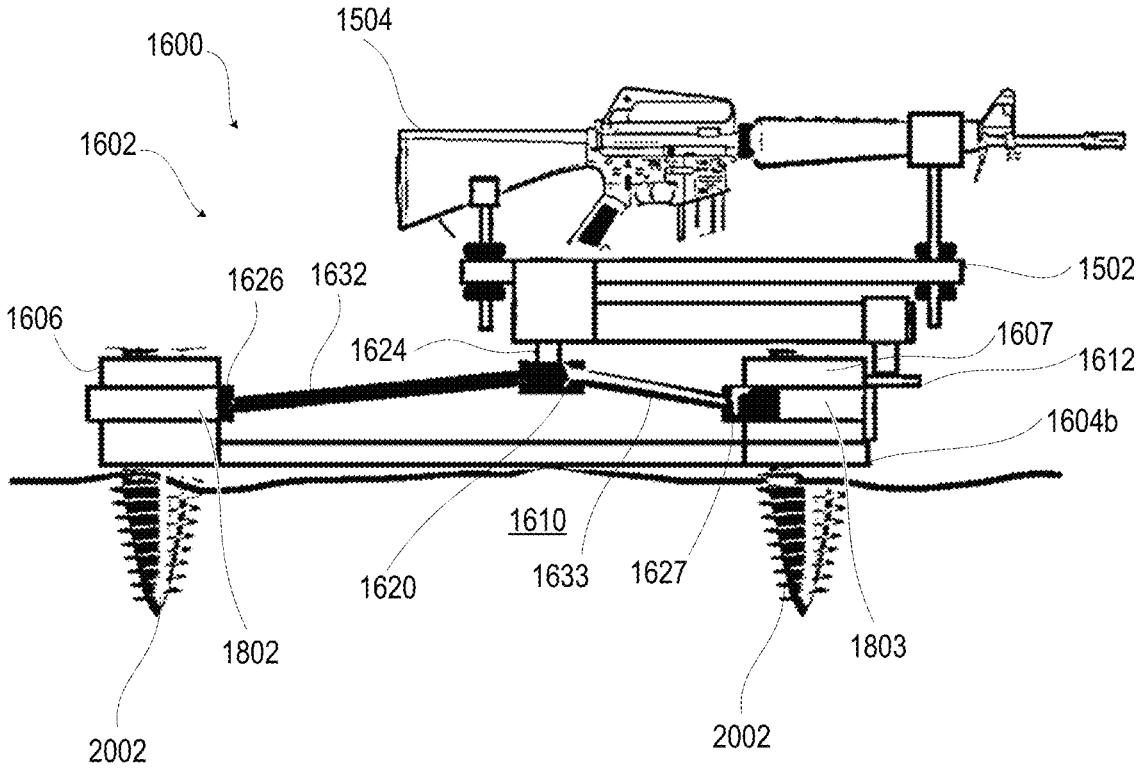
FIG. 20 is a side view of the shooting rest stabilizer system having an example unitary shooting rest mount of FIG. 19 configured with ground mounting screws, according to one or more embodiments.

FIG. 20 is a side view of a stabilized shooting rest system 1600 supporting and stabilizing the shooting rest 1502 of FIG. 16 and including an example unitary shooting rest mount platform 1604*b* that includes all of the components of example unitary shooting rest mount platform 1604*a* of FIG. 19. In addition, the unitary shooting rest mount platform 1604*b* is configured with ground mounting stakes or screws 2002.

Figure 21:
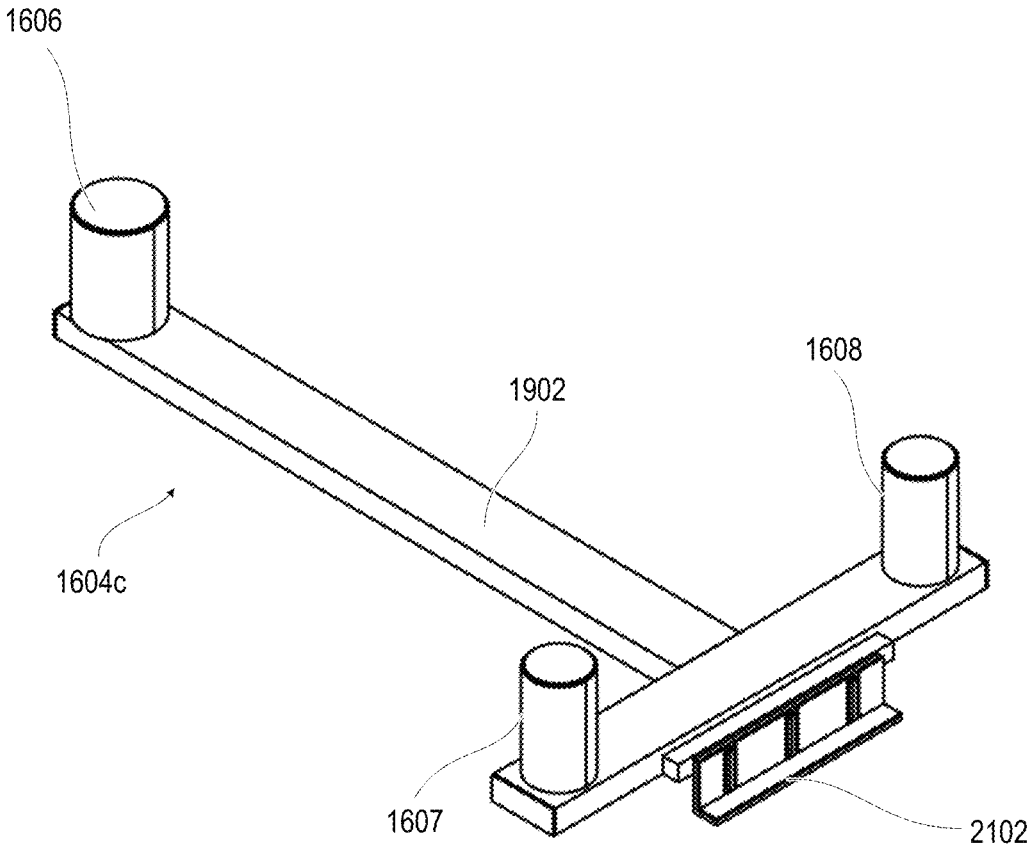
FIG. 21 is an isometric view of the example unitary shooting rest mount of FIG. 19 with a front truck bed fixture, according to one or more embodiments.

FIG. 21 is an isometric view of an example unitary shooting rest mount platform 1604*c* that includes the components of the unitary shooting rest mount platform 1604*a* of FIG. 19 and additionally includes a truck bed fixture 2102.

Figure 22:
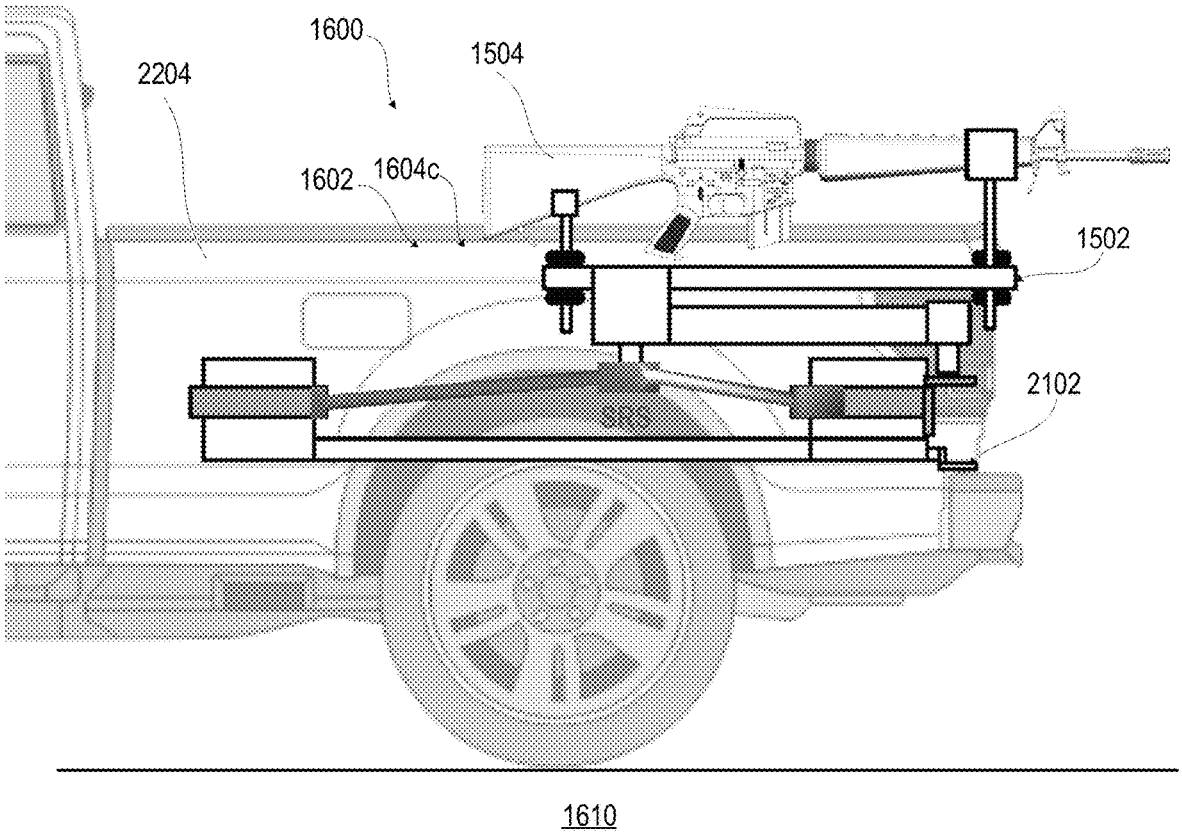
FIG. 22 is a side view of the shooting rest stabilizer system having the example unitary shooting rest mount of FIG. 21 with the truck bed fixture secured to a truck bed of a truck vehicle, according to one or more embodiments.

FIG. 22 is a side view of the shooting rest stabilizer system 1600 having the example unitary shooting rest mount platform 1604*c* with the front truck fixture 2102 directly securing the shooting rest stabilizer system 1600 to a truck vehicle 2204, which in turn indirectly secures to the stationary ground surface 1610.

Figure 23:
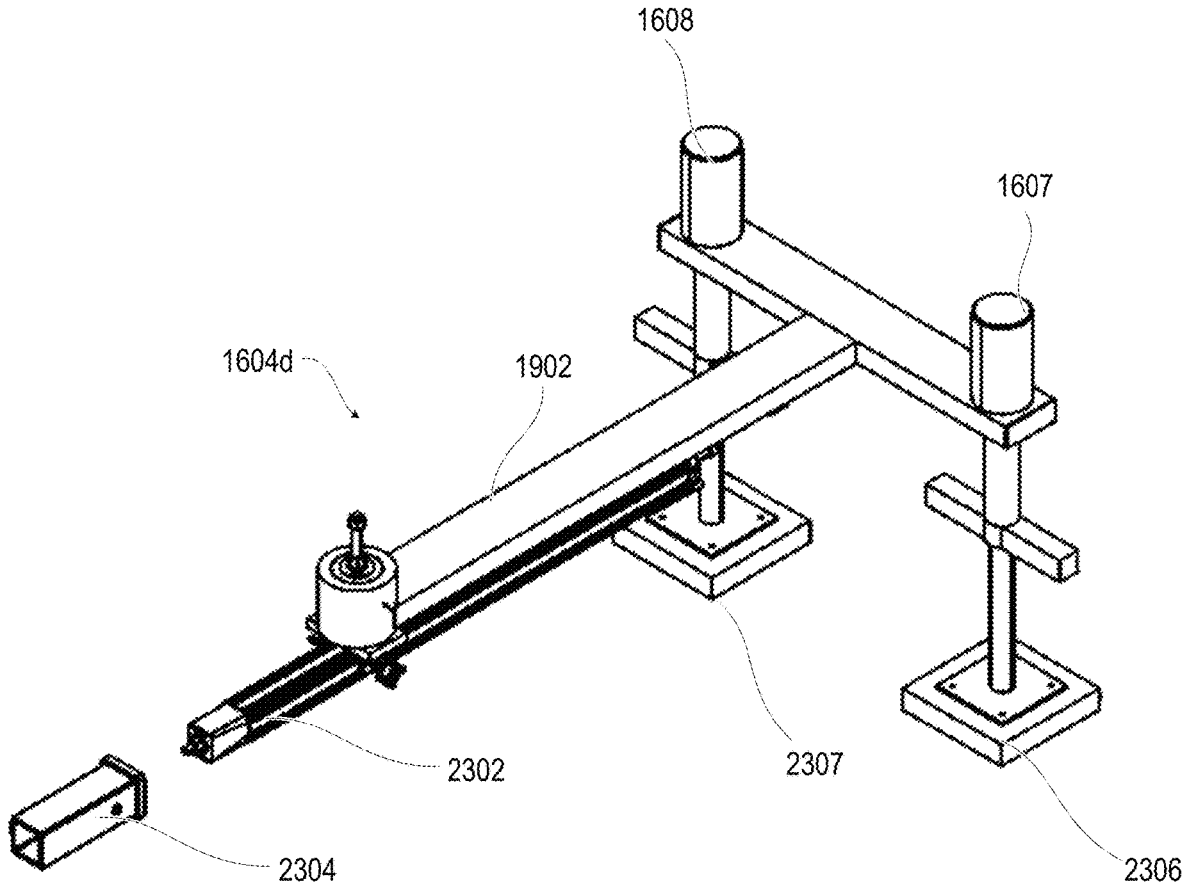
FIG. 23 is an isometric view of an example unitary shooting rest mount of FIG. 19 with a front fixture further configured with two ground supports and a hitch fixture for mounting to a vehicle draw bar, according to one or more embodiments.

FIG. 23 is an isometric view of an example unitary shooting rest mount platform 1604*d* that has the components of unitary shooting rest mount platform 1604*a* of FIG. 19. Additionally, example unitary shooting rest mount platform 1604*d* includes a back hitch drawbar 2302 engageable to a vehicle hitch 2304. Example unitary shooting rest mount platform 1604*d* includes a front right ground support 2306 and a front left ground support 2307.

Figure 24:
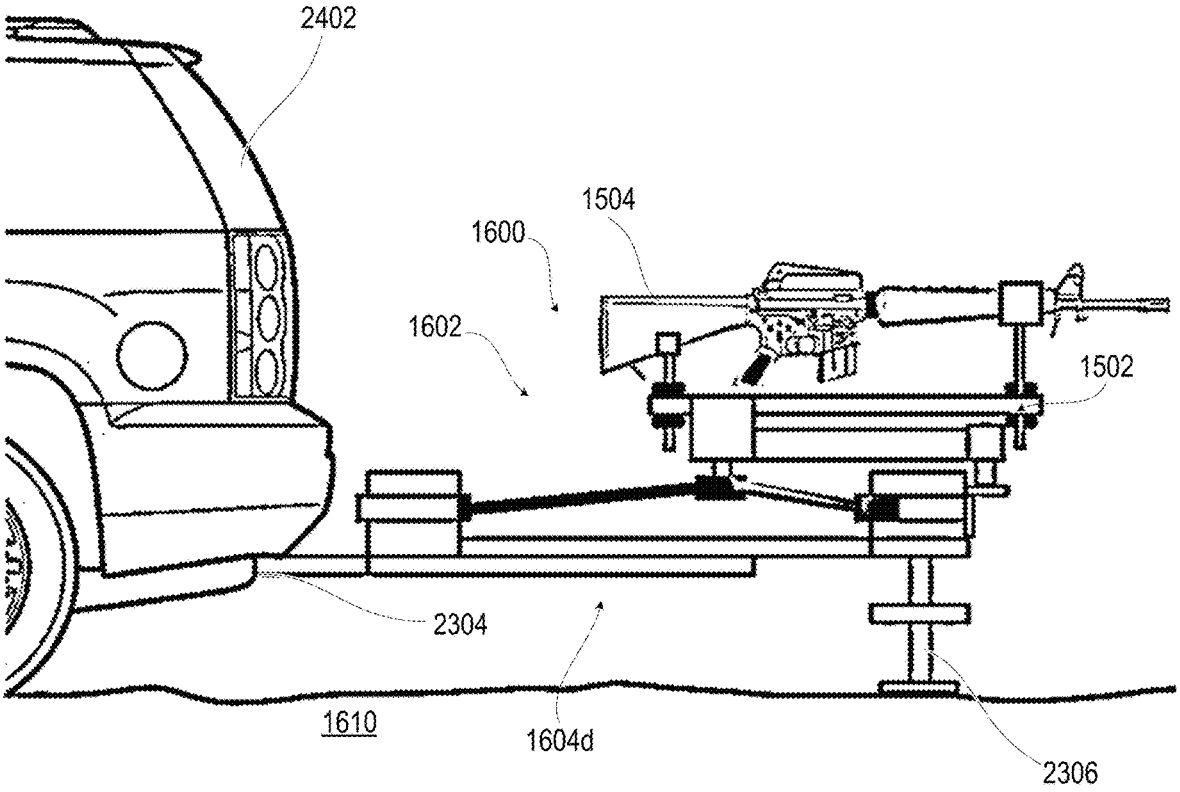
FIG. 24 is a side view of the example unitary shooting rest mount of FIG. 23 mounted to a vehicle draw bar of a vehicle and supporting a firearm or weapon and shooting rest that is stabilized with the shooting rest stabilizer, according to one or more embodiments.

FIG. 24 is a side view of the shooting rest stabilizer system 1600 having the example unitary shooting rest mount platform 1604*d* secured to the vehicle hitch 2304 of a vehicle 2402. The shooting rest stabilizer system 1600 is supporting and stabilizing the shooting rest 1502 that holds the weapon 1504.

Figure 25:
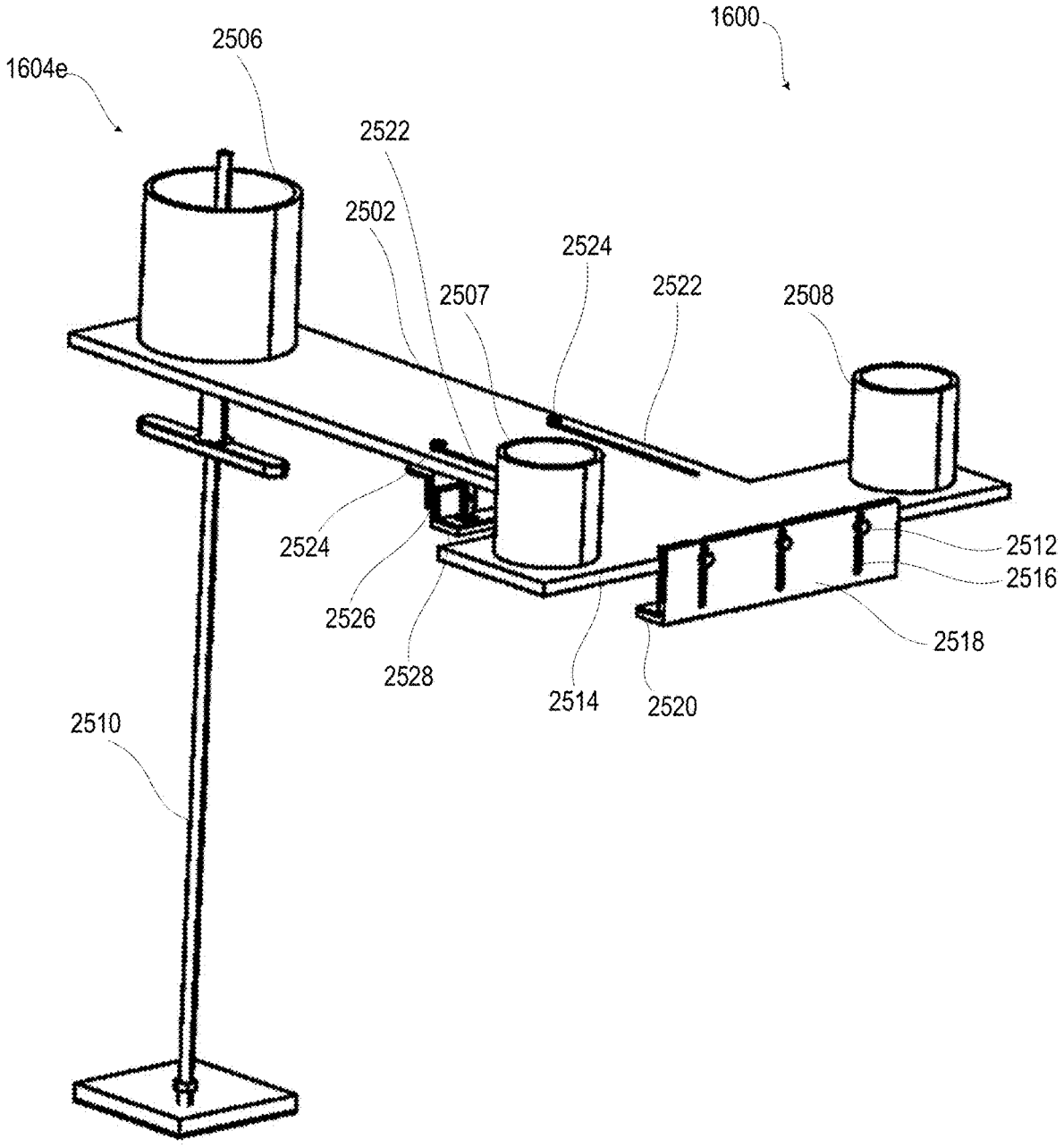
FIG. 25 is an isometric view of an example unitary shooting rest mount of FIG. 19 with a rear ground stand and a front bracket fixture, according to one or more embodiments.

FIG. 25 is an isometric view of an example unitary shooting rest mount platform 1604*e* having a T-shaped connecting table 2502 that supports from below a back support 2506, a front right support 2507 and a front left support 2508 with a rear ground stand 2510 extending downward below the back support 2506. Forward projecting fasteners 2512 from a forward edge 2514 of the T-shaped connecting table 2502 are received in corresponding vertical slots 2516 in a front lateral fixture 2518 having a lower backward directed flange 2520 that is vertically adjustable relative to the T-shaped connecting table 2502. A pair of parallel longitudinal slots 2522 formed through the T-shaped connecting table 2502 rearward to the front right support 2507 and the front left support 2508 receive fasteners 2524 attached to an opposing mid bracket 2526 extending vertically and laterally beneath the T-shaped connecting table 2502 and having a forward lower flange 2528. The opposing mid bracket 2526 is positionable longitudinally rearward and forward.

Figure 26:
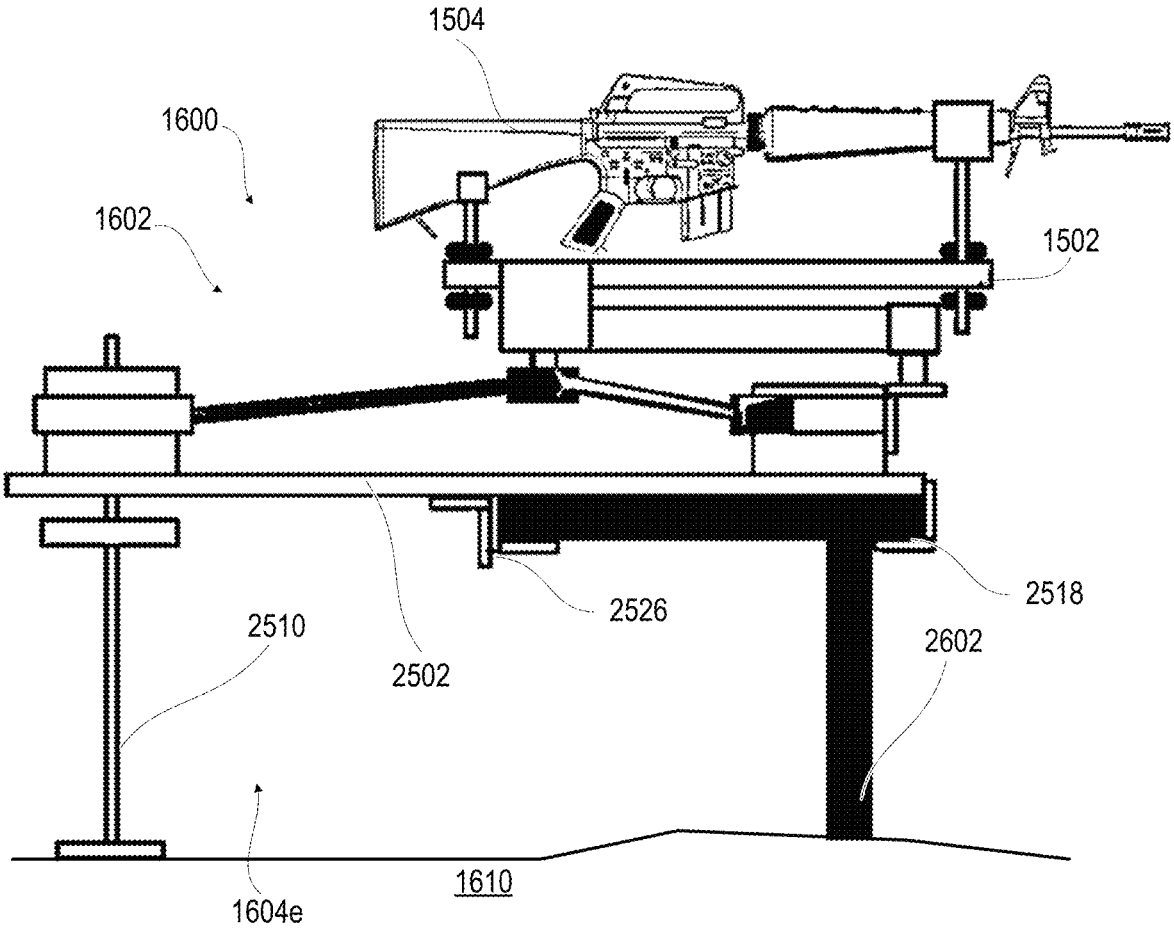
FIG. 26 is a side view of the example unitary shooting rest mount of FIG. 25 having the front bracket fixture secured to a bench platform and supporting a firearm or weapon and shooting rest that is stabilized with the shooting rest stabilizer, according to one or more embodiments.

FIG. 26 is a side view of the shooting rest stabilizer system 1600 including the example unitary shooting rest mount platform 1604*e* adjusted to secure to a bench platform 2602. Rear ground stand 2510 is adjusted in height to place T-shaped connecting table 2502 horizontally on top of bench platform 2602. Front lateral fixture 2518 and opposing mid bracket 2526 are adjusted to secure a forward portion T-shaped connecting table 2502 to the bench platform 2602. The shooting rest stabilizer system 1600 is supporting and stabilizing the shooting rest 1502 that holds the weapon 1504.

While the disclosure has been described in detail in reference to specific embodiments thereof, it will be apparent to one skilled in the art that various changes and modifications can be made therein without departing from the spirit and scope of the embodiments. Additionally, while the examples provided herein related to specific analytes, the present disclosure is not limited to these analytes and may be used to detect a wide variety of analytes of interest. Thus, it is intended that the present disclosure cover the modifications and variations of this disclosure provided they come within the scope of the appended claims and their equivalents.

While the disclosure has been described with reference to exemplary embodiments, it will be understood by those skilled in the art that various changes may be made, and equivalents may be substituted for elements thereof without departing from the scope of the disclosure. In addition, many modifications may be made to adapt a particular system, device or component thereof to the teachings of the disclosure without departing from the essential scope thereof. Therefore, it is intended that the disclosure is not limited to the particular embodiments disclosed for carrying out this disclosure, but that the disclosure will include all embodiments falling within the scope of the appended claims. Moreover, the use of the terms first, second, etc. do not denote any order or importance, but rather the terms first, second, etc. are used to distinguish one element from another.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The description of the present disclosure has been presented for purposes of illustration and description but is not intended to be exhaustive or limited to the disclosure in the form disclosed. Many modifications and variations will be apparent to those of ordinary skill in the art without departing from the scope of the disclosure. The described embodiments were chosen and described in order to best explain the principles of the disclosure and the practical application, and to enable others of ordinary skill in the art to understand the disclosure for various embodiments with various modifications as are suited to the particular use contemplated.

What is claimed is:

1. A shooting rest stabilizer system comprising:

a shooting rest stabilizer comprising:

a base plate having an orifice configured to receive a downward projecting rear adjustment bolt or leg of a shooting rest, the base plate comprising an interface mechanism selectively lockable to the adjustment bolt or leg to allow for vertical adjustment of the adjustment bolt or leg;

a back mounting block engageable to a back support, a front right mounting block engageable to a front right support, and a front left mounting block engageable to a front left support, wherein the back support, the front right support and the front left support are securable to a stationary base surface and a front lateral fixture is couplable between the front right support and the front left support to receive a front right leg and a front left leg of the shooting rest;

a back elongate support attached between a rear edge of the base plate and the back mounting block;

a front right elongate support attached between a front right edge of the base plate and the front right mounting block; and a front left elongate support attached between a left front edge of the base plate and the front left mounting block, wherein the shooting rest stabilizer is configured to resist movement of the shooting rest in response to firing of a firearm or weapon supported by the shooting rest.

2. The shooting rest stabilizer system of claim 1, further comprising:

a back clamp attached to the back mounting block and vertically adjustable and selectively engageable to the back support that extends vertically upward;

a front right clamp attached to the front right mounting block and vertically adjustable and selectively engageable to the front right support that extends vertically upward; and a front left clamp attached to the front left mounting block and vertically adjustable and selectively engageable to the front left support that extends vertically upward.

3. The shooting rest stabilizer system of claim 1, wherein each of the back elongate support, the front right elongate support, and the front left elongate support of the shooting rest stabilizer are vertically pivotably attached to the base plate to facilitate positioning of the base plate above the back mounting block, the front right mounting, and the front left mounting.

4. The shooting rest stabilizer system of claim 1, wherein each of the back elongate support, the front right elongate support, and the front left elongate support of the shooting rest stabilizer comprise a length adjustment mechanism that is a linearly expandable and compressible to impart a stabilizing force on the base plate.

5. The shooting rest stabilizer system of claim 1, wherein each of the back elongate support, the front right elongate support, and the front left elongate support of the shooting rest stabilizer comprise a telescoping length adjustment mechanism that is selectively longitudinally adjustable to accommodate spacing between the base plate and a corresponding one of the base support, the front right support and the front left support and selectively engageable to a fixed length for use.

6. The shooting rest stabilizer system of claim 1, further comprising:

a unitary shoot rest mount platform comprising the back support, the front right support and the front left support, and a connecting structure attached to the back support, the front right support and the front left support.

7. The shooting rest stabilizer system of claim 6, wherein the unitary shooting rest mount platform comprising at least one ground engaging member that secures a corresponding one of the base support, the front right support, and the front left support to the stationary base surface.

8. The shooting rest stabilizer system of claim 6, wherein the unitary shooting rest mount platform comprises at least one truck bed fixture engageable to a truck bed to secure the shooting rest stabilizer system directly to a truck vehicle and indirectly to the stationary base surface.

9. The shooting rest stabilizer system of claim 6, wherein the unitary shooting rest mount platform comprises:

a front right ground support attachable to the front right support and positionable on the stationary base surface;

a front left ground support attachable to the front left support and positionable on the stationary base surface; and a back hitch drawbar engageable to a vehicle hitch to secure the shooting rest stabilizer system directly to a vehicle and indirectly to the stationary base surface.

10. The shooting rest stabilizer system of claim 6, wherein the unitary shooting rest mount platform comprises:

a background support attachable to the back support and positionable on the stationary base surface; and a front lateral fixture engageable to a bench to secure the shooting rest stabilizer system indirectly to the stationary base surface.

* * * * *